US011701287B1

(12) United States Patent
Lindstrom

(10) Patent No.: US 11,701,287 B1
(45) Date of Patent: Jul. 18, 2023

(54) MICROTRACTION BED

(71) Applicant: Peter Carl Lindstrom, Albuquerque, NM (US)

(72) Inventor: Peter Carl Lindstrom, Albuquerque, NM (US)

( * ) Notice: Subject to any disclaimer, the term of this patent is extended or adjusted under 35 U.S.C. 154(b) by 809 days.

(21) Appl. No.: 16/660,533

(22) Filed: Oct. 22, 2019

Related U.S. Application Data

(60) Provisional application No. 62/750,415, filed on Oct. 25, 2018.

(51) Int. Cl.
*A61H 1/02* (2006.01)
*A47C 20/04* (2006.01)
*A47C 31/12* (2006.01)

(52) U.S. Cl.
CPC ..... *A61H 1/0222* (2013.01); *A47C 20/04* (2013.01); *A47C 20/041* (2013.01); *A47C 20/043* (2013.01); *A47C 20/048* (2013.01); *A47C 31/123* (2013.01); *A61H 2203/0475* (2013.01); *A61H 2205/081* (2013.01); *A61H 2230/805* (2013.01)

(58) Field of Classification Search
CPC ..... A61H 1/0222; A47C 20/04; A47C 20/043; A47C 20/041; A47C 31/123; A61H 1/0229; G01G 19/445; A61H 2205/081; A61H 2230/805
See application file for complete search history.

(56) References Cited

U.S. PATENT DOCUMENTS 1,693,320 A * 11/1928 Smith et al. ..... A47C 20/04 5/618
2,690,175 A * 9/1954 Daughtry ..... A61H 1/0222 606/243
3,404,679 A * 10/1968 Bevilacqua ..... A61H 1/02 606/242
3,420,229 A * 1/1969 Miller ..... A61H 1/0222 606/243
3,640,272 A * 2/1972 Hussey ..... A61H 1/0222 601/99
4,144,880 A * 3/1979 Daniels ..... A61H 1/0292 606/242
4,356,816 A * 11/1982 Granberg ..... A61H 1/0222 606/241
4,539,978 A * 9/1985 Lundblad ..... A61H 1/02 606/243
4,691,919 A 9/1987 Roberson
4,896,659 A 1/1990 Goldish
(Continued)

*Primary Examiner* — David R Hare
*Assistant Examiner* — Alison N Labarge
(74) *Attorney, Agent, or Firm* — Peacock Law P.C.; Justin R. Muehlmeyer

(57) ABSTRACT

Beds and methods for applying a micro traction force on the body of a user over time to treating or relieve back/spinal pain. Embodiments of a bed according to the present invention provide a section of the bed that is movable relative to other sections of the bed and apply a restorative force to the movable section such that when a user lays on the movable section, the movable bed section is displaced and a tractive force is applied to the user's body due to a force apparatus applying a force thereto. The movable bed section can be suspended by a tensional support and/or supported by a compressional support in various configurations disclosed herein.

33 Claims, 24 Drawing Sheets

(56) References Cited

U.S. PATENT DOCUMENTS

| | | | | |
|---|---|---|---|---|
| 5,010,880 | A | 4/1991 | Lamb | |
| 5,192,306 | A * | 3/1993 | Scott et al. | A61G 13/009 5/608 |
| 5,466,205 | A | 11/1995 | McLane et al. | |
| 6,302,859 | B1 | 10/2001 | Cushman | |
| 6,592,501 | B1 | 7/2003 | Mayes | |
| 7,189,214 | B1* | 3/2007 | Saunders | A61H 1/0292 5/618 |
| 7,354,414 | B2 | 4/2008 | Perrego | |
| 2006/0059814 | A1* | 3/2006 | Metz et al. | G01G 19/445 52/309.8 |
| 2010/0263941 | A1* | 10/2010 | Kurata et al. | G01G 19/445 177/25.13 |
| 2020/0060907 | A1* | 2/2020 | Childs et al. | A61G 7/0527 |

* cited by examiner

MICROTRACTION BED

CROSS-REFERENCE TO RELATED APPLICATIONS

This application claims priority to and the benefit of the filing of U.S. Provisional Pat. Application No. 62/750,415, entitled "Microtraction Bed", filed on Oct. 25, 2018, and the specification thereof is incorporated herein by reference.

BACKGROUND OF THE INVENTION

Embodiments of the present invention relate to a bed, more particularly, a bed for placing the spine of the user in traction to relieve or treat back/spinal pain.

Chronic low back pain - and in particular axial, localized back pain - has proved difficult to treat and is often impossible to eliminate altogether. Surgical interventions are often inappropriate, and when performed can have negative outcomes. Prescription drugs are generally insufficient to eliminate back pain, have side effects, and can be addictive. For these reasons first line therapies are conservative: physical therapy, massage, acupuncture, yoga, transcutaneous electrical nerve stimulation, and traction are examples. Traction (also referred to herein as the "tractive force", "traction force", "state of traction", etc.) simply refers to the application of a force to stretch the user's spine, which can be accomplished by applying a force that pulls one part of the user's body away from another part of the user's body. Prior traction solutions have typically placed a large tractive force (in some cases well over 100 pounds) on the patient's back for a short period of time, typically minutes. While some find this kind of therapy helpful, this is not universal. What is lacking in existing solutions is a way to apply a small amount of traction over a very long period of time - several hours, for example - in a way that is comfortable and does not waste valuable daylight hours. Such a method can be used at night while the user is sleeping, and augment the spinal decompression which occurs naturally during night-time hours.

To apply large traction forces a variety of strategies have been employed. For example, harnesses or straps have been used to anchor the head or other body parts. The tractive force has generally been exerted in one of three ways: by a motor, the user's muscles, by gravity, or by a combination of these mechanisms. The simplest solutions invariably make use of gravity or muscle power. For obvious reasons, the use of muscle power for exerting a traction force over an extended period of time is undesirable, as is the use of straps or harnesses, which hinder the altering of sleeping position. Also, no solutions to date use a person's own body weight to exert a traction force while the person lies horizontally; all previous solutions which use the subject's own body weight to exert a tractive force on the spine position the subject at an angle to the vertical, which degrades sleep quality.

What is needed is a mechanism to apply a traction force to a user's spine while the user lays flat and not at an incline with nothing attached to the user's body.

BRIEF SUMMARY OF EMBODIMENTS OF THE PRESENT INVENTION

Embodiments of the present invention are directed to a bed apparatus for treating or relieving back/spinal pain of a user, the bed apparatus comprising: a main frame comprising a head end and a foot end; a movable section disposed on the main frame between the head end and the foot end, the movable section supported by a support apparatus and configured to move in relation to the main frame when there is a change in the weight applied to the center section; and a restorative force apparatus disposed on the movable section. In another embodiment, the movable section is configured to move in relation to the main frame when the user applies at least some of his or her weight to the movable section.

In some embodiments, the bed apparatus further comprises a head section comprising a head platform disposed on said main frame at or near said head end; and a foot section comprising a foot platform disposed at or near said foot end; wherein the movable section comprises a center platform and is disposed between said head section and said foot section. In some embodiments, the movable section further comprises a subframe, and the support apparatus comprises a tensional support and a compressional support, and the restorative force apparatus is communicably coupled to apply force to at least one of the subframe, the movable section or the support apparatus. In some embodiments, tensional support is placed in tension by fixing its top in place relative to the main frame and is otherwise able to move towards and away from the head end and the foot end. In some embodiments, the tensional support comprises a spanning member at its top that can be moved towards the head of the bed or towards the foot of the bed. In some embodiments compressional support is placed in compression by fixing its bottom in place relative to the main frame and is otherwise able to move towards and away from the head end and the foot end. In some embodiments, the compressional support comprises a spanning member at its bottom that coordinates with the main frame. In some embodiments, the subframe further comprises rails on opposite sides of the subframe and cross members on opposite ends of the subframe, the rails and cross members attached together such that they move together as a unit. In some embodiments, the subframe further comprises a cross brace attached to the rails. In some embodiments, the movable section is configured such that its center of mass lies about halfway between the tensional support and the compressional support. In some embodiments, the main frame comprises at least one position coordinator at or near the foot end to receive the foot section at one or more positions along the length of the bed apparatus. In some embodiments, the at least one position coordinator comprises notches or slots. In some embodiments, the center platform is narrower in width than both the head section and the foot section. In some embodiments, the head platform is removably attachable to the main frame or rotatable therefrom. In some embodiments, the center platform is removably attachable to the subframe or rotatable therefrom. In some embodiments, the head section further comprises a head mattress section disposed on the head platform, the foot section further comprises a foot mattress section disposed on the foot platform, and the movable section further comprises a center mattress section disposed on the center platform. In some embodiments, the foot mattress section is thinner in depth than each of the head mattress section and the foot mattress section. In some embodiments, the head platform and the center platform are angled in relation to the foot platform. In some embodiments, the subframe comprises holders for blocks disposed between the subframe and the center platform, and the main frame further comprises holders for blocks disposed between the main frame and the head platform. In some embodiments, the bed apparatus also includes sensors, and in some embodiments the sensors are disposed on the holders or beneath the blocks.

In some embodiments, the main frame comprises at least one panel extending above at least one of the head platform or the foot platform, the support apparatus comprising a tensional support disposed on each of the at least one panel and the movable section. In some embodiments, the restorative force apparatus comprises at least one of the group consisting of an elastic band, cable and weight, cable and spring, cable and ratchet, cable and spring and ratchet, hydraulic mechanism, and motorized device. In some embodiments, the at least one panel comprises a first panel on a first side of the bed and a second panel on an opposite side of the bed. In some embodiments, the tensional support comprises at least two cables, a first cable attached to the first panel and the movable section and a second cable attached to the second panel and the movable section. In some embodiments, each of the first and the second cables comprise an adjustment apparatus for adjusting the length or tension thereof. In some embodiments, the first panel and the second panel each comprise at least two cable receivers to provide a plurality of different mounting-positions for the cables. In some embodiments, at least two cable receivers comprise notches or slots at or near the top of a respective one of the first panel and the second panel.

In some embodiments, the movable section comprises a supported base platform and a support base, wherein the supported base platform at least partially surrounds the support base or is at least partially disposed above the support base and the supported base platform is suspended in relation to the support base by the support apparatus. In some embodiments, the restorative force apparatus is attached to the supported base platform and either the head section module or the main frame. In some embodiments, support apparatus comprises a tensional support and the tensional support comprises a plurality of cables. In some embodiments, the support apparatus comprises a compressional support. In some embodiments, the foot section comprises a foot section base and the foot section base is attached to the support base by a bridge. In some embodiments, the main frame comprises rails and each of the head section, foot section and movable section are disposed on the rails. In some embodiments, the bed comprises a gap between the foot section and the foot end of the main frame. In some embodiments, the bed comprises wheels or bearings, and the main frame is inclined at an angle relative to the ground.

Embodiments of the present invention are also directed to a bed apparatus for treating or relieving spinal pain of a user, the apparatus comprising: a first bed section and a second bed section both disposed on a frame comprising a head end and a foot end, the second bed section configured to move in relation to the frame by a first force apparatus when there is a change in the weight applied to the second bed section; a second force apparatus applying a force on the second bed section in either the direction of the head end or the foot end. In another embodiment,the bed apparatus comprises at least one panel extending above the first bed section and the second bed section,the first force apparatus is disposed on both of the at least one panel and the second bed section.

Embodiments of the present invention are also directed to a method of applying a microtraction force to the spine of a user to treat or relieve spinal pain, the method comprising: configuring a section of a bed to move in relation to the frame of the bed when there is a change in the weight applied to the section of the bed, wherein the section of the bed is supported either by a tensional support, a compressional support, or a combination thereof; and wherein the bed is configured to apply a force to the section of the bed in either the direction of a head of the bed or a foot of the bed to apply a traction force to the spine of the user when the user, which force is a function of weight applied to the section of the bed.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. Although some of the figures illustrate dimensions, the use of such dimensions is merely intended to provide the reader with the most preferred embodiment of the invention - to be clear, such dimensions are not essential to the operation of the invention and one or more, or even all, of the dimensions can be changed and will provide desirable results. The drawings are only for the purpose of illustrating one or more embodiments of the invention and are not to be construed as limiting the invention. In the drawings.

DETAILED DESCRIPTION OF THE INVENTION

Figure 1:
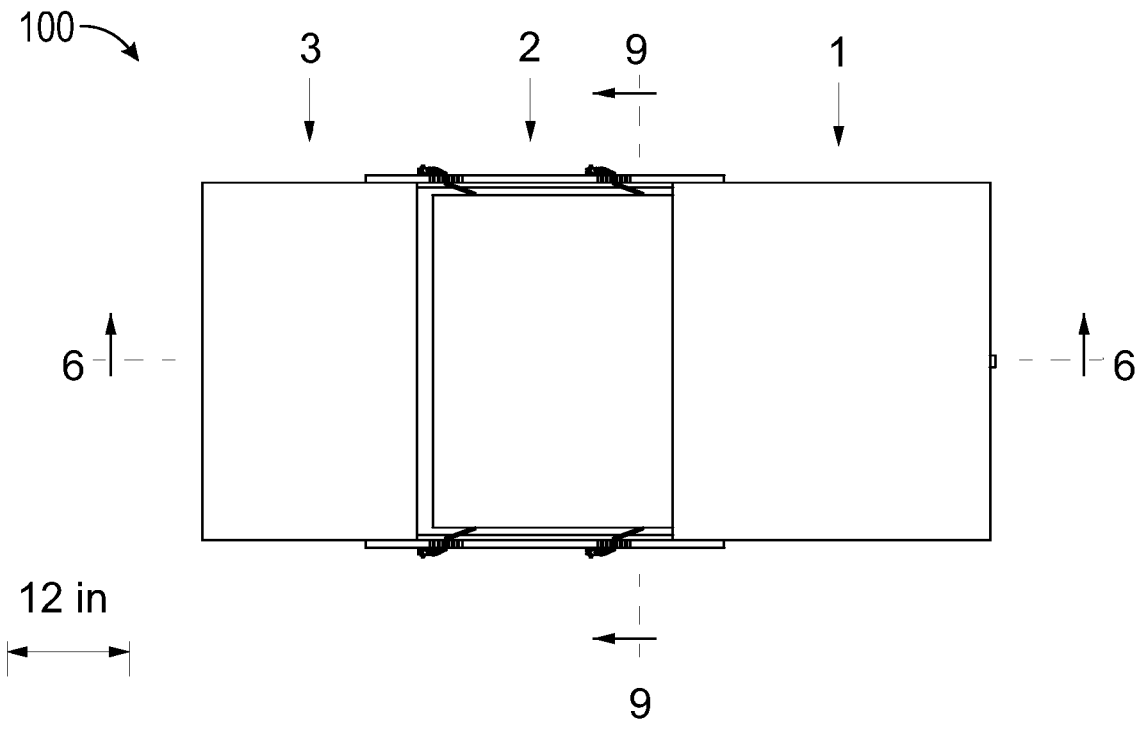
FIG. 1 is an illustration of a top view of a bed apparatus according to an embodiment of the present invention that is referred to herein as "Configuration A"
Figure 2:
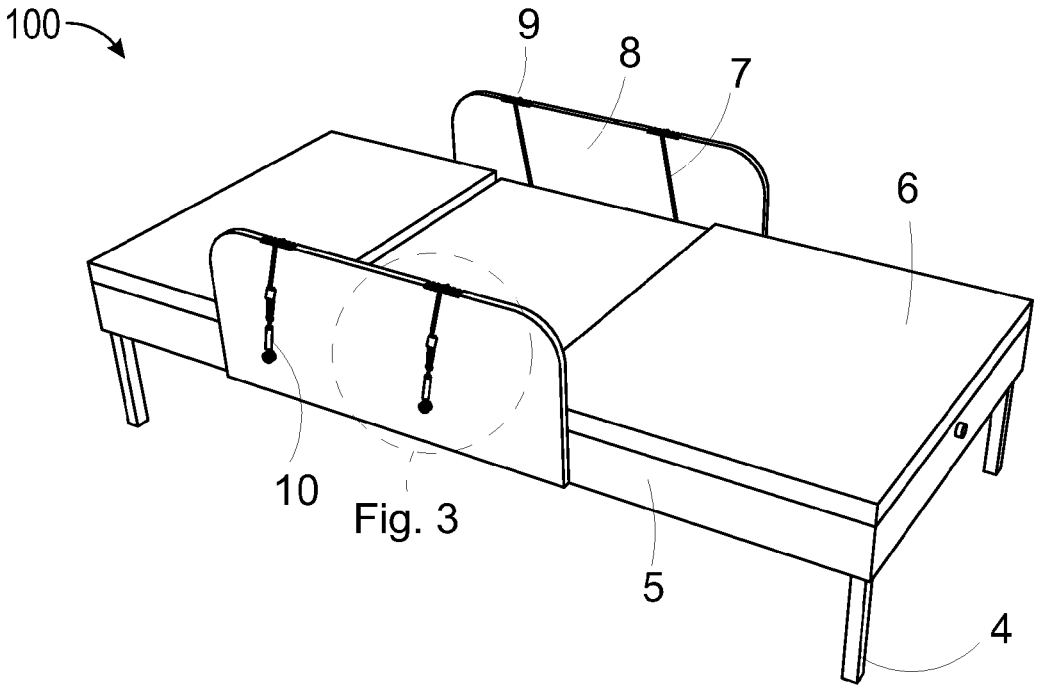
FIG. 2 is an illustration of a perspective view of a bed apparatus according to an embodiment of the present invention that is referred to herein as "Configuration A"
Figure 3:
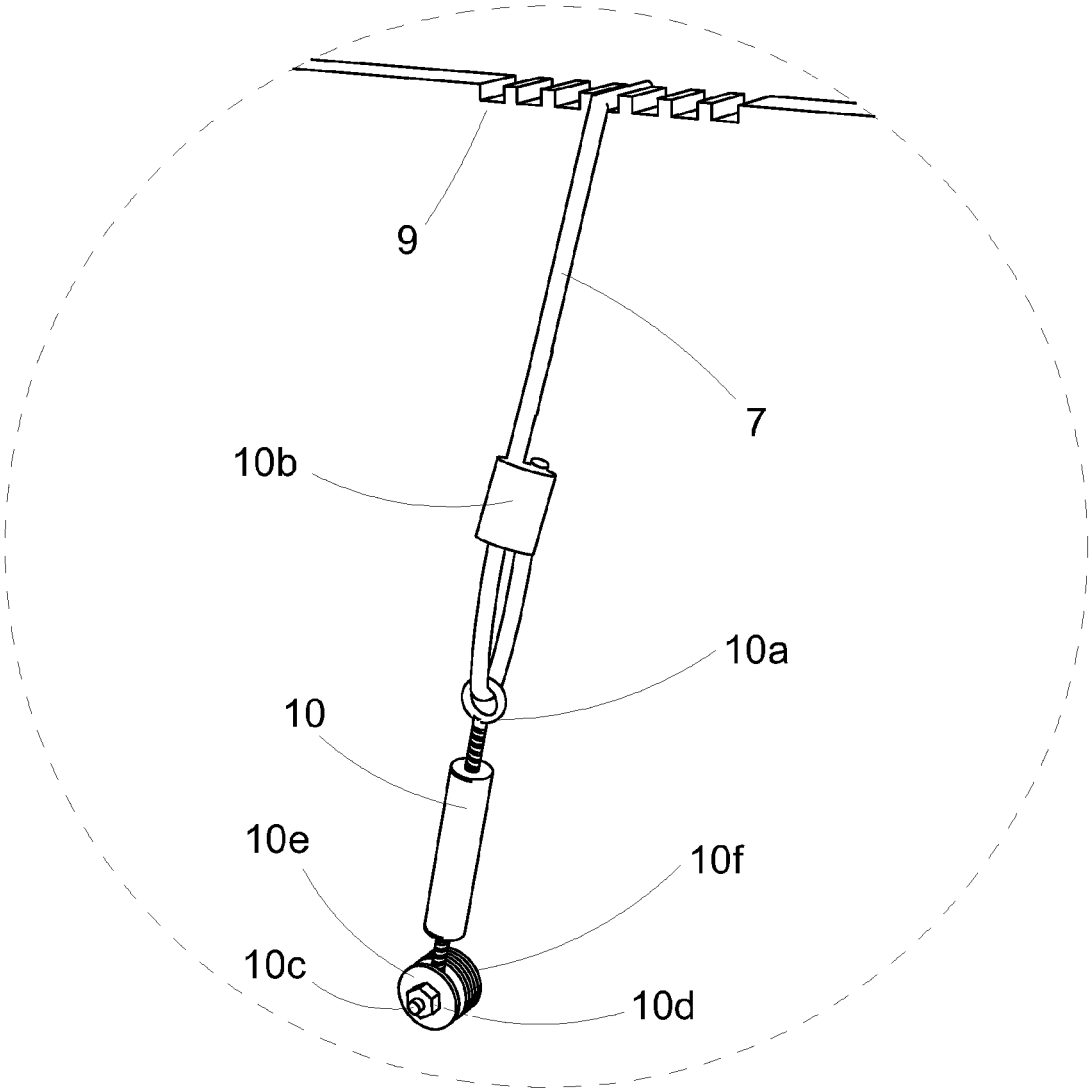
FIG. 3 is an illustration of a perspective view of a force apparatus on a panel of a bed apparatus according to an embodiment of the present invention that is referred to herein as "Configuration A"

Referring to the figures, embodiments of various beds according to the present invention provide various configurations for applying forces on a movable bed section, for example center bed section 2, so that it is responsive to the weight of a portion of the user's lower body, which may include the user's hips, thighs, and knees, calves and feet. When the user lifts his or her hips off of the bed by arching the spine, center bed section 2 moves forward toward the head of the bed. As used throughout this application, the term "head" of the bed refers to the direction that is towards that part of the bed on which the head of the user would rest, for example, head bed section 1. As used throughout this application, the term "foot" of the bed refers to the direction that is towards that part of the bed opposite the head of the bed, that is, that part of the bed on which the feet of the user would rest, foot bed section 3. This direction may also be referred to as the "rear". For example, the "rear" side of an object would be that part of the object toward or furthest in the direction of the foot of the bed. As used throughout this application, the term "top" shall mean the surface that is furthest away from the ground as the bed apparatus would rest when it is positioned in its normal use position. Another way to define "top" is as that portion of the object closest to the surface on which the user of the bed would lay when the bed is used in its normal use position, because the user would lay on the top surface of the bed apparatus. The term "top" may also be used to refer to the direction that is toward the head of the bed. As used throughout this application, the term "bottom" shall refer to the opposite direction or surface than the "top" and may be used to refer to the direction that is toward the foot of the bed. As used throughout this application, the term "backwards" shall mean toward the foot of the bed, unless otherwise defined or illustrated. The term "attached" as used throughout this application does not necessarily mean that the subject object it is permanently attached, but can refer to it being removably attachable as well or rotatable therefrom. The terms "back" and "spine" can be interchangeably used throughout this application. The term "back" should not be construed to mean the lumber spine only, but rather encompasses any portion of the backbone/spine.

In order to illustrate principles of various embodiments of the invention, a number of embodiments of various beds are described and referred to herein. Many of the features of one embodiment can be combined with or replaced by features of another embodiment even though such features may be referred to in only one configuration and with separate reference numbers.

Embodiments of the various beds of the present invention are also designed to eliminate the need for straps and harnesses or any other object that restricts or restrains the user's body to the bed. Embodiments of the beds of the present invention do not require such objects, thereby providing users to use the bed without such restrictions that are uncomfortable, dangerous and unnecessary to provide traction in the way provided by the various embodiments of the present invention described herein.

Configuration A

In one embodiment, bed 100 is illustrated in FIGS. 1-12 and is also referred to herein as Configuration A ("Config. A"). Bed 100 is configured such that, when the user drops his or her hips onto center bed section 2, this section moves backwards by a small amount, which can be, for example, about 1 inch or less, thus placing the lower spine of the user in a state of traction. Because all forces placed on the body are either normal forces (that is, perpendicular to the plane of contact), frictional forces, or gravitational force, no clamps or straps, which attach to the body, are necessary. The user may therefore change sleeping positions easily. The ease with which the user may change positions, and the use of gravity to exert traction on a horizontally-lying user makes embodiments of the present invention unique among traction tables, which have heretofore not allowed a user to sleep comfortably. The configuration may also be adapted to place the neck in traction, as described further herein.

Bed 100 is preferably constructed of three principle sections, head bed section 1, center bed section 2, and foot bed section 3, which each preferably comprises a base 5 and a soft mattress material 6. Preferably, base 5 is made of a rigid material, which can include but is not limited to wood, metal, plastic or combinations thereof. Soft mattress material 6 preferably comprises foam, but another soft material including but not limited to padding, rubber, or a spring mattress (or combinations thereof), can also be used. Two of the bed sections, head bed section 1 located at the head of the bed and foot bed section 3 located at the foot of the bed, are preferably immobile in relation to each other and center bed section 2. The entire bed 100 can optionally be supported above the floor on supports 4, if desired. Center bed section 2, located at the center of the bed, is preferably suspended by cables 7. Any number of cables 7 can be used to suspend center bed section 2, but four is preferred. One end of each one of cables 7 is preferably attached to an anchor 12, which is preferably a pressed-fit tube through which the cable travels (see FIG. 10). Anchors 12 are preferably located on the interior of center bed section 2 and prevent cables 7 from slipping through holes 5*c* drilled into the base 5*b* of the center bed section (see FIG. 10), although any method of attaching the cables to the center bed section can suffice. Cables 7 travel from their anchors 12, through holes 5*c* drilled in base 5*b* of the movable section to the top of support panel 8, one of which is preferably attached to each side of the bed (see FIG. 9). In another embodiment, each support panel 8 may be replaced with a truss to lighten the bed. The height of each support panel 8 is not strictly determined. Higher panels 8 result in a smaller change in the angle 11*b* (see FIG. 11) that cables 7 deviates from vertical when traction is applied (see below). Lower panels result in a greater change in angle 11*b*, but make the bed easier to get into and out of. As used throughout this application, the term "panel" should be interpreted to include any object that can extend a distance and support the features described herein as being supported by the panel, including but not limited to, frame, truss, rail, flange, board, pole, etc.

Cables 7 can be attached to, at, or near the top of support panels 8. However, bed 100, allows easy adjustment of the traction force, as will become clear later. Rather than having each cable 7 be attached to a fixed point at the top of a support panel 8, each cable 7 preferably instead travels through one of several slots 9 (see FIGS. 2, 3) formed into the top of one of the support panels 8, and then proceeds down the lateral side of this support panel. Lastly, each cable is preferably attached to bed frame 8*b* (see FIG. 10). This can be accomplished in any desired manner, but it is preferably accomplished by passing each cable through a metal loop 10*a* that is part of a turnbuckle 10 (see FIG. 3). Cable 7 is then preferably clamped to turnbuckle 10 via a pressed metal fastener 10*b* (see FIG. 3). Turnbuckle 10 is preferably attached to the side of support panel 8 and bed frame 8*b* by means of bolt 10*c*, nut 10*d*, and washer 10*e*. Spacer washers 10*f* ensure turnbuckle 10 has enough clearance to turn without contacting support panel 8. Another washer 10*g* is preferably placed between the head of bolt 10*h* and bed frame 8*b*. By turning turnbuckle 10 the user is able to shorten or lengthen the turnbuckle, which results in raising or lowering the corner of the center bed section 2 which is attached to turnbuckle 10 by means of the corresponding support cable 7. This means of adjustment, while advantageous, is not essential. Any method of attaching each cable 7 to bed frame 8*b* can be used. An advantage of providing turnbuckle 10 is that the height of center bed section 2 can be easily raised or lowered. This can be helpful in treating knee pain: by raising the edge of the center bed section 2 closest to the foot of the bed, the user's knees can be raised above their feet, relieving torsional forces on the knees.

A force, which can be referred to as the restoring force, is preferably exerted on movable center bed section 2 in a direction which points towards the head of the bed 100. In bed 100, this force is preferably accomplished using a mechanism illustrated in FIG. 6. Magnified views (FIGS. 7 and 8) illustrate three holes 14*a*, 14*b*, 14*c* which have been cut into head bed section 1 and center bed section 2. Stretched elastic band 13, or another elastic or resilient material, preferably passes through these holes and is anchored at both ends by larger diameter sections 15*a*, 15*b*. These larger diameter sections are preferably knots in elastic band 13, or the elastic band can be attached to a separate part made of wood, metal, or another suitable material. Configured in this manner, elastic band 13 preferably pulls center bed section 2 toward head bed section 1. As noted before, however, there are other methods of exerting a constant (or quasi-constant) restoring force on the center bed section, as long as this force points towards the head of bed 100.

Figure 4:
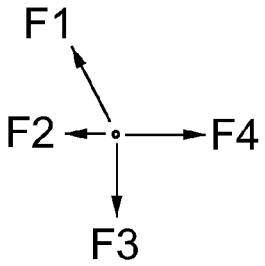
FIG. 4 is a free body diagram of various forces acting on a center section of a bed apparatus according to an embodiment of the present invention that is referred to herein as "Configuration A", illustrating the various forces when the user is not lying on the bed.
Figure 5:
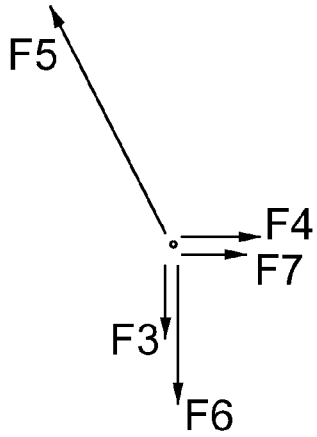
FIG. 5 is a free body diagram of various forces acting on a center section of a bed apparatus according to an embodiment of the present invention that is referred to herein as "Configuration A", illustrating the various forces when the user is lying on the bed.
Figure 6:
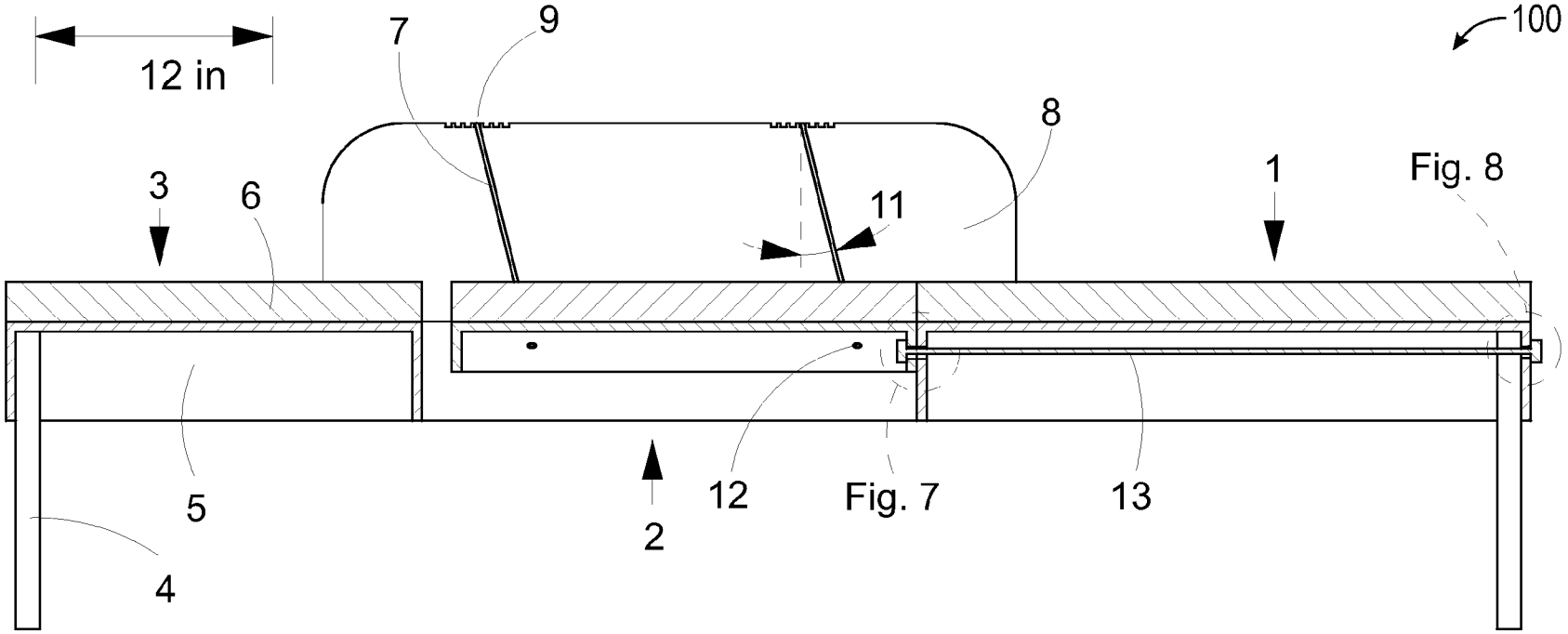
FIG. 6 is an illustration of a side cross-sectional view of a bed apparatus according to an embodiment of the present invention that is referred to herein as "Configuration A"
Figure 8:
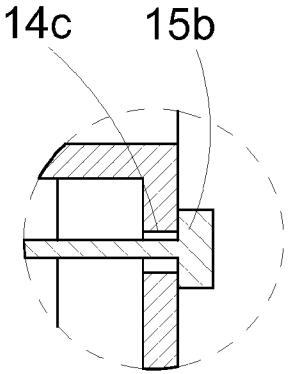
FIG. 8 is an illustration of a magnified cross-sectional view of a bed apparatus according to an embodiment of the present invention that is referred to herein as "Configuration A", illustrating a first force apparatus and its relation to a section of the bed and the frame.
Figure 7:
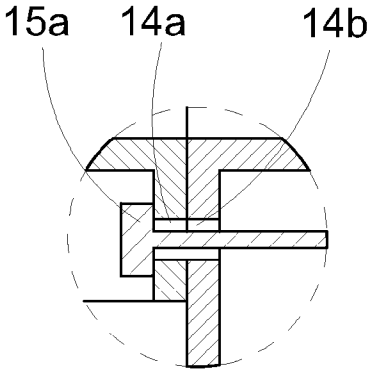
FIG. 7 is an illustration of a magnified cross-sectional view of a bed apparatus according to an embodiment of the present invention that is referred to herein as "Configuration A", illustrating a first force apparatus and its relation to sections of the bed.
Figure 9:
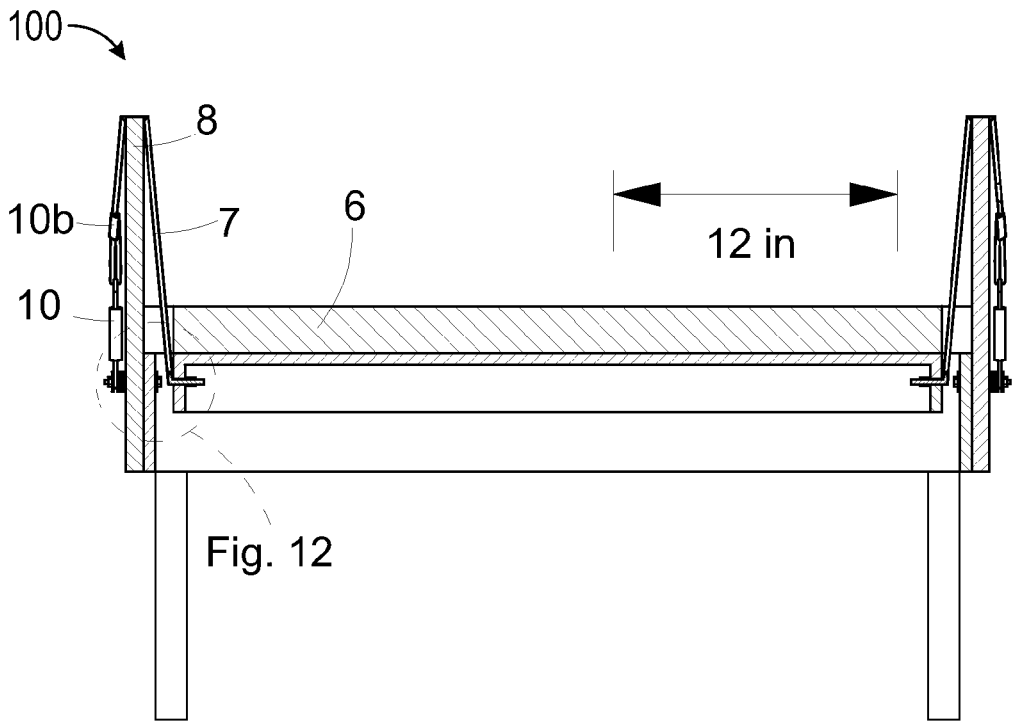
FIG. 9 is an illustration of a cross-sectional view from the head of a bed apparatus according to an embodiment of the present invention that is referred to herein as "Configuration A", illustrating the center bed section in suspension with a first force apparatus.
Figure 10:
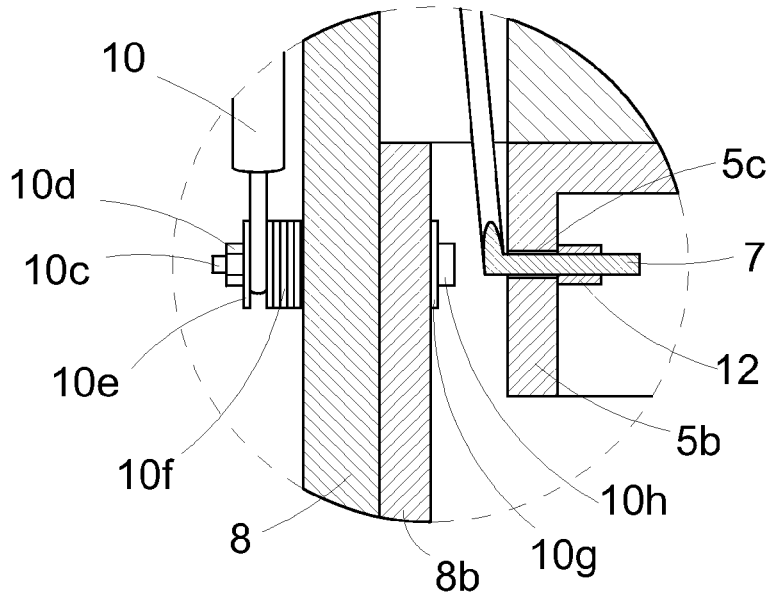
FIG. 10 is an illustration of a magnified cross-sectional view from the head of a bed apparatus according to an embodiment of the present invention that is referred to herein as "Configuration A", illustrating a portion of the center bed section in suspension with a portion of a first force apparatus and its relation with a panel and the frame.
Figure 11:
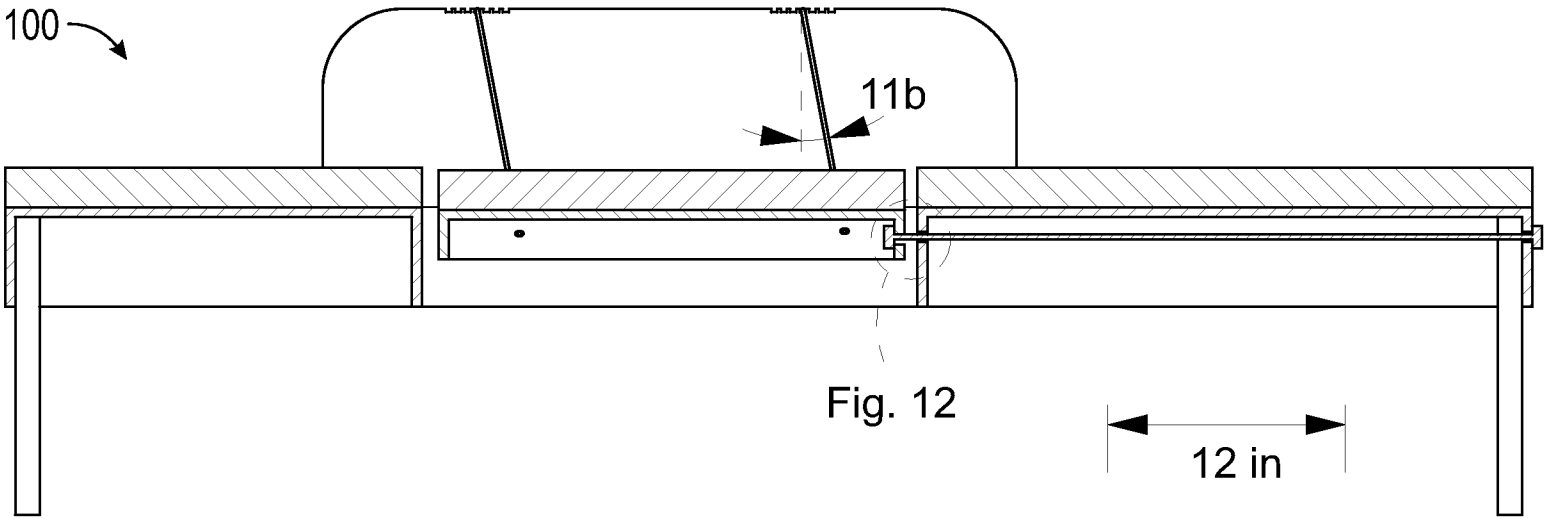
FIG. 11 is an illustration of a cross-sectional view from a side of a bed apparatus according to an embodiment of the present invention that is referred to herein as "Configuration A", illustrating a second force apparatus and its relationship with the bed sections and frame.
Figure 12:
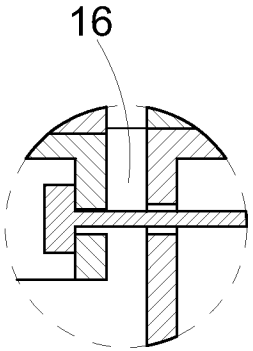
FIG. 12 is an illustration of a magnified cross-sectional view from a side of a bed apparatus according to an embodiment of the present invention that is referred to herein as "Configuration A", illustrating a second force apparatus and its relationship with the bed sections.

Center bed section 2 is preferably free to move like a swing. FIGS. 4 and 5 are free body diagrams which illustrate the forces acting on center bed section 2. If the user is not lying on bed 100, or if the user is lying on the bed but raises his hips off center bed section 2 by arching his spine, the forces acting on center bed section 2 are as illustrated in FIG. 4. Cables 7 exert tension forces on center bed section 2. Because all four of the tension forces act in the same direction, the free body diagram illustrates these forces combined into one net force, indicated by vector F1. Cables 7 do not necessarily hang straight down, but can hang at angle 11 to the vertical (see FIG. 6). Therefore, force F1 has both vertical and horizontal components. Force F3 is the weight of the center bed section 2. Force F4 is the restoring force due to the elastic band. Lastly, force F2 is the normal force exerted on center bed section 2 by head bed section 1. By normal force it is meant a force exerted perpendicular to a plane of contact.

If the user now drops his hips onto center bed section 2 (and depending on the size of this section and the size of the user, his thighs, knees, and calves may also rest on this section) the forces acting on center bed section 2 are as illustrated in FIG. 5. The remainder of the user's lower body may now rest on the foot bed section 3. The portion of the user's body which rests on center bed section 2 exerts a normal force F6 downward on this section. In order for center bed section 2 to remain in equilibrium, the vertical component of the tension force F5 must increase in magnitude. Therefore, the horizontal component of F5 also increases in magnitude. The restoring force F4 remains nearly constant (a small displacement of the center bed section 2, discussed later, results in a small increase in the restoring force, but this is negligible). Therefore, another force preferably pulls center bed section 2 toward the head of the bed in order for the net force in the horizontal direction to remain zero. This force is labeled F7 and is the frictional force exerted on center bed section 2 by the portion of the user's body which is in contact with the center bed section. Center bed section 2 is therefore pulled toward the head bed section 1. By Newton's third law, a corresponding force must exist; in this case it is the frictional force that the center bed section 2 exerts on the portion of the user's body which is in contact with it. The bed therefore pulls the user's hips, and possibly also his thighs, knees, and calves toward the foot of the bed. This effect is the "tractive force" or "traction force". This places the user's spine in the desired state of traction.

Center bed section 2 preferably moves a small amount toward foot bed section 3, and also downward (see FIGS. 11, 12), leaving gap 16 between the head bed section 1 and center bed section 2. When this occurs, angle 11*b* of cables 7 decreases but remains positive. As this angle remains positive, the reasoning related to the free body diagrams (FIGS. 4 and 5) remains valid, because this reasoning does not depend on the exact angle the net tension force makes with the vertical. However, the traction force will decrease in magnitude as angle 11*b* decreases. Ideally, it is preferable that the traction force remain constant over the full range of motion of the center section. That the traction force decreases as the center section moves backward is rectified in later embodiments of the present invention.

In order to change the position of his body or reset the position of center bed section 2, the user need only lift his hips off center bed section 2 by arching his body. When he does this, center bed section 2 moves forward, pulled in that direction by restoring force F4, until it is in contact with the forward and immobile head bed section 1, where it is stopped by the normal force F2. When the user drops his hips back onto bed 100, the traction force is resumed. If the user is not strong enough to arch his back, he can also scoot forward, bringing both his hips and the center bed section 2 toward the head of the bed.

The magnitude of the tractive force may be altered by changing the angle one or more of cables 7 make with the vertical. This can be accomplished by changing which notch 9 in the supporting panels 8 each cable 7 passes through. A greater angle with respect to the vertical results in a greater tractive force. Alternatively, and/or additionally, one may adjust the magnitude of the tractive force by changing the magnitude of the restoring force. A greater restoring force, for example, results in less of a tractive force, and vice versa. In bed 100, this can be accomplished by lengthening or shortening elastic band 13, or by exchanging one band for another with a greater or lesser elastic constant (Hook's constant). If elastic band 13 has been knotted to increase its diameter at its ends (15*a*, 15*b*) its length may be changed by changing the location of one or more of the knots.

Even though center bed section 2 moves with respect to the other two bed sections 1 and 3, a single sheet may be placed over all three sections, provided that enough slack is left in the sheet so that the movable center section may move back and forth. Bed 100 requires no special bedding.

Configuration B

Figure 13:
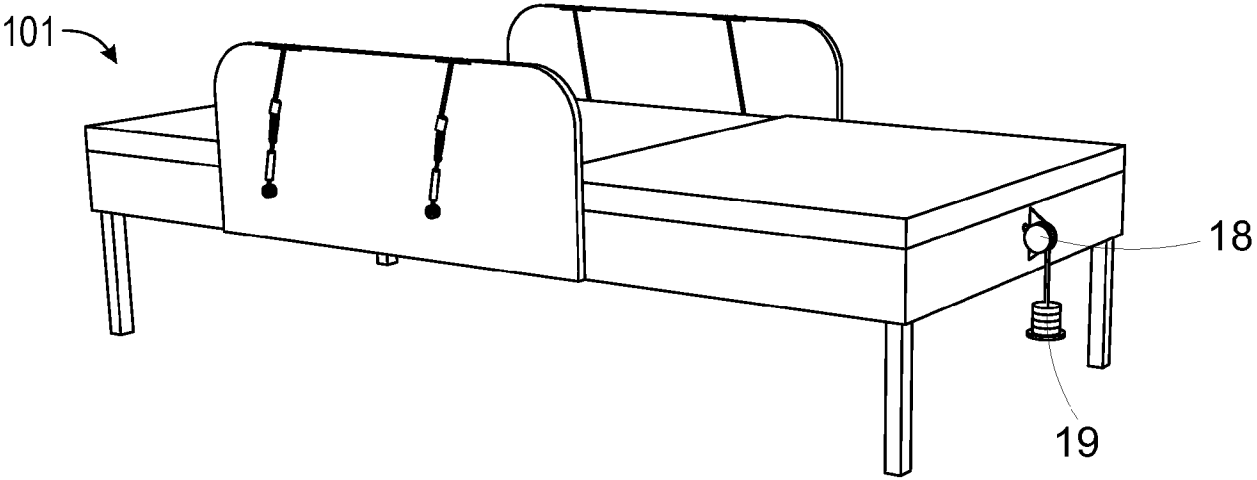
FIG. 13 is an illustration of a perspective view of a bed apparatus according to an embodiment of the present invention that is referred to herein as "Configuration B", illustrating a second force apparatus comprising a counterweight.
Figure 14:
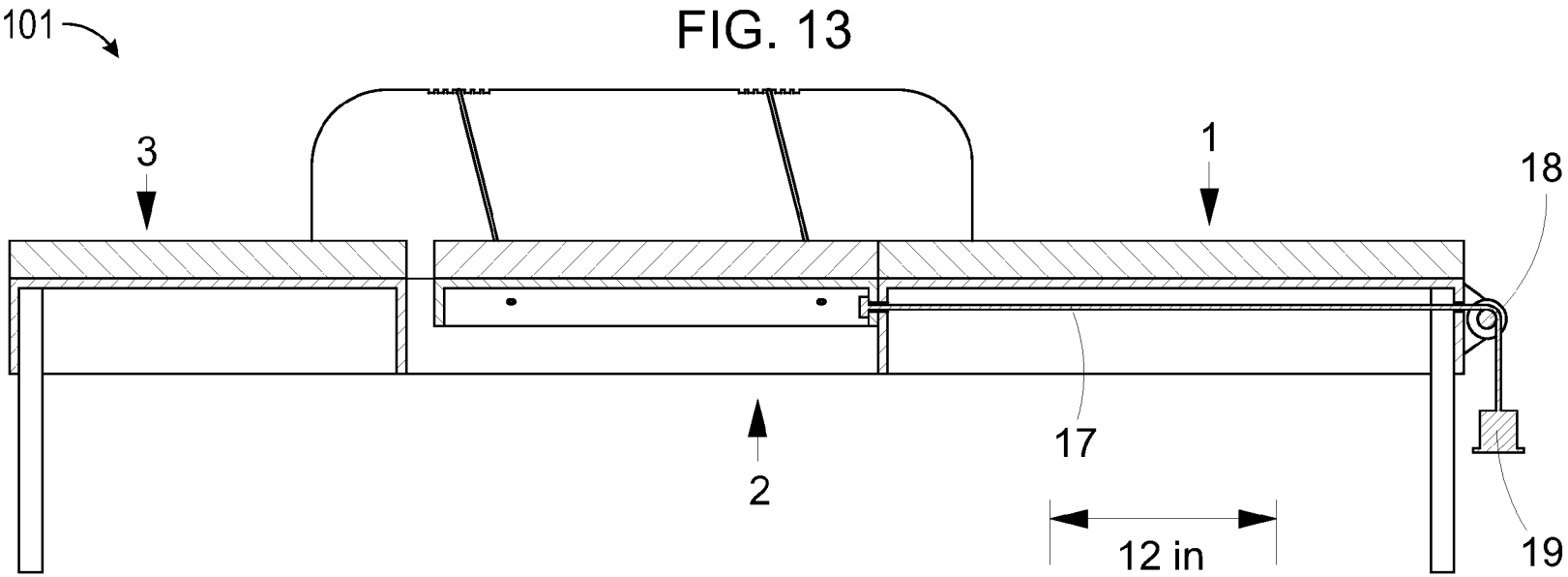
FIG. 14 is an illustration of a side cross-sectional view of a bed apparatus according to an embodiment of the present invention that is referred to herein as "Configuration B", illustrating a second force apparatus comprising a counterweight.
Figure 15:
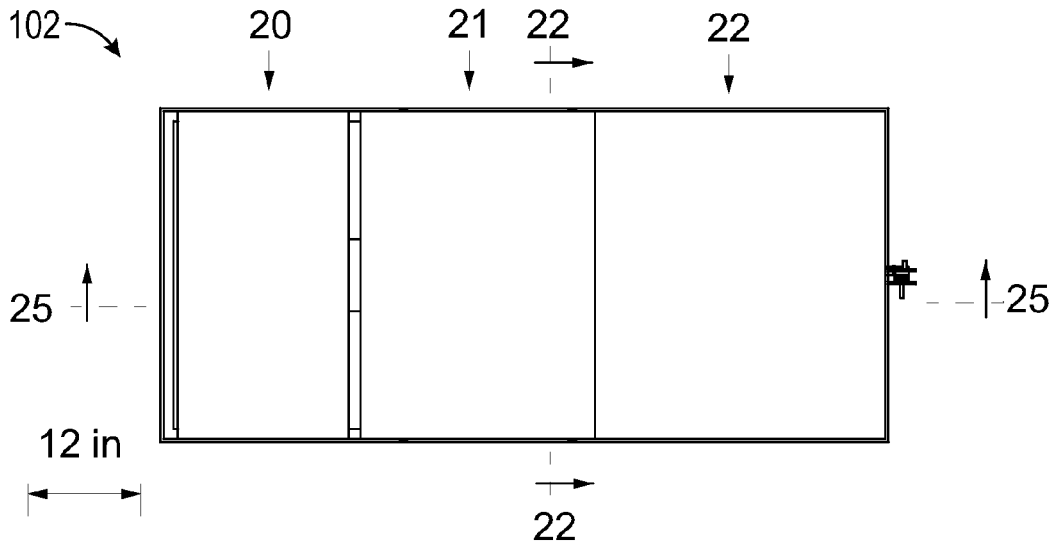
FIG. 15 is an illustration of a top view of a bed apparatus according to an embodiment of the present invention that is referred to herein as "Configuration C"

As discussed above, the restoring force can result from any kind of mechanical mechanism, so long as this arrangement exerts a constant or quasi-constant force on center bed section 2 that points toward the head of the bed. Yet another embodiment of a bed according to the present invention, bed 101, is illustrated in FIGS. 13 and 14 and can also be referred to herein as Configuration B ("Config. B"). A cable 17 is attached to the movable center bed section 2 and runs from there, through holes in the center bed section 2 and head bed section 1 (in the same manner as elastic band 13 does in bed 100) over a pulley 18, and is finally attached to a counterweight 19. The weight pulls on cable 17, which in turn pulls center bed section 2 toward the head of the bed. If counterweight 19 is constructed such that incremental weights can be added to the counterweight, the magnitude of the restoring force can be easily altered. This, in turn, changes the magnitude of the tractive force in the manner discussed in the description of bed 100.

Configuration C

Figure 18:
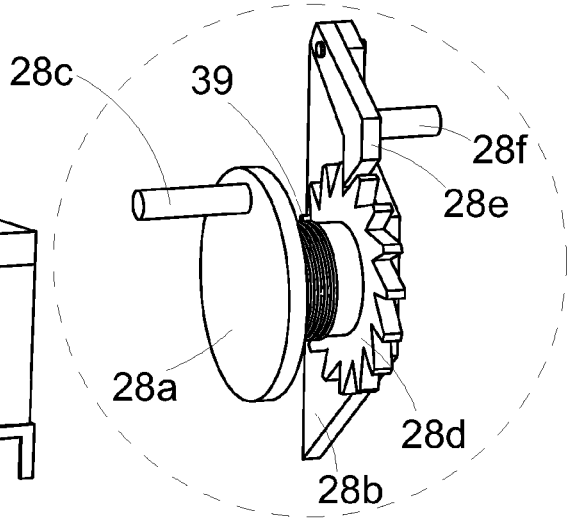
FIG. 18 is a magnified illustration of a second force apparatus of a bed apparatus according to an embodiment of the present invention that is referred to herein as "Configuration C"
Figure 19:
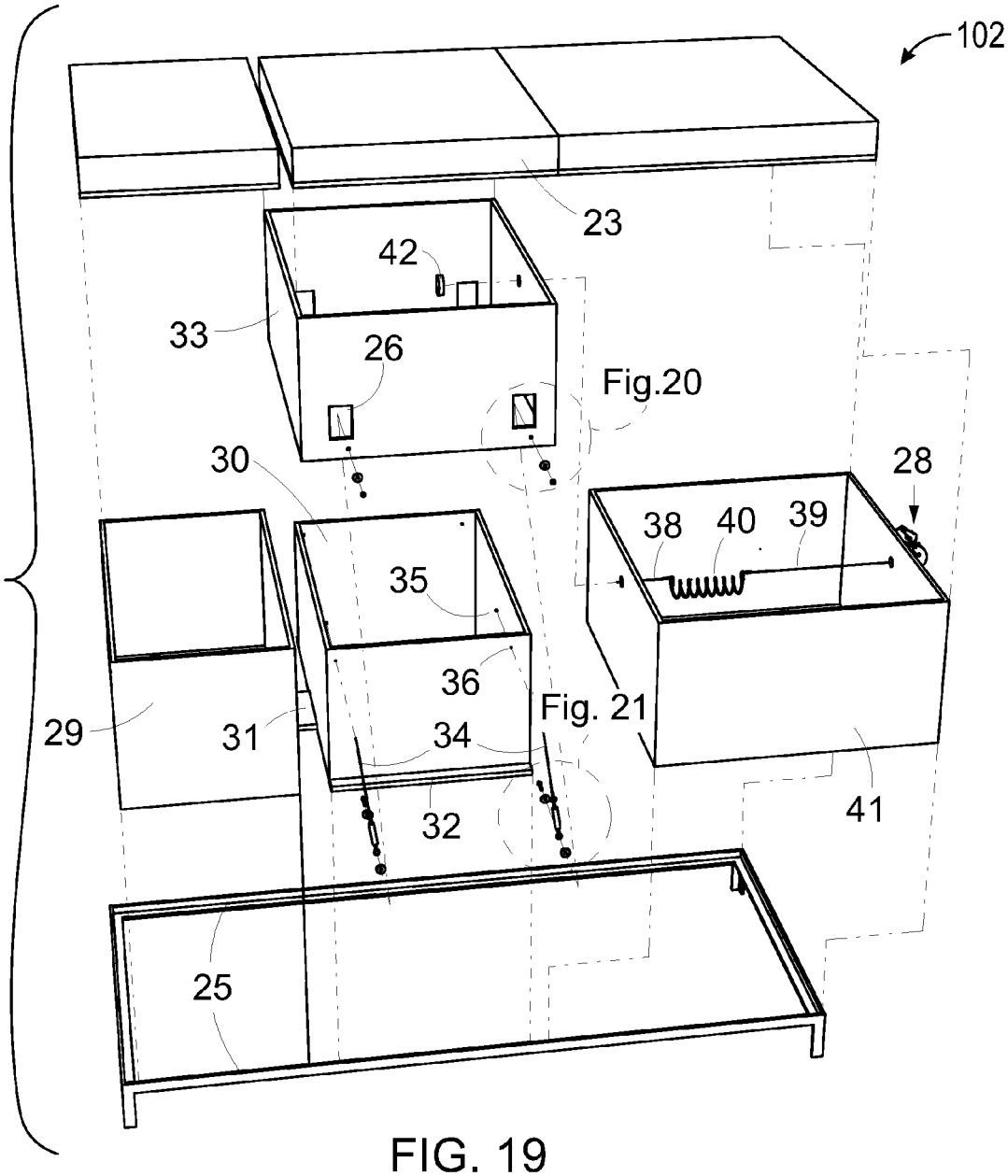
FIG. 19 is an exploded illustration of a perspective view of a bed apparatus according to an embodiment of the present invention that is referred to herein as "Configuration C"
Figure 20:
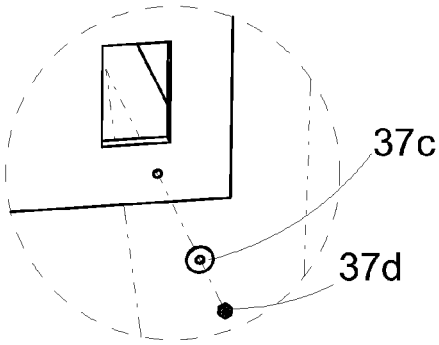
FIG. 20 is a magnified illustration of a bed apparatus according to an embodiment of the present invention that is referred to herein as "Configuration C", illustrating a portion of the supported outer base of the center section of the bed.
Figure 21:
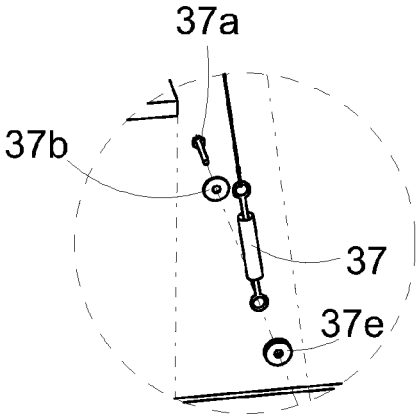
FIG. 21 is a magnified illustration of a bed apparatus according to an embodiment of the present invention that is referred to herein as "Configuration C", illustrating a portion of a first force apparatus.

In a further embodiment of the present invention, bed 102, is illustrated in FIGS. 15-25 and is also referred to herein as Configuration C ("Config. C"). Like bed 100 and bed 101, bed 102 is divided into three sections: immobile head bed section 22 and foot bed section 20, and a movable center bed section 21. As in bed 100 and bed 101, the center bed section 21 is suspended by cables 34, however cables 34 are preferably hidden from view so that the bed more closely resembles a normal bed. For each section, soft mattress material 23 is preferably disposed atop a base 24 (see FIG. 16), made of a sturdy material, including but not limited to wood, metal, a combination thereof, or another suitable material. Each base 24 preferably rests on a frame of rails 25, made of wood, metal, or another suitable material. FIG. 19 is an exploded view which illustrates how this configuration is put together. Base 29 of foot bed section 20 is attached to the inner support base 30 of center section 21 of the bed by means of a short bridge 31. The box-like portion of the inner support base 30 is preferably not as wide as the distance between the rails. It therefore comprises flanges 32 that extend from its edges so that it fits securely on rails 25. The supported outer base 33 of center bed section 21 is suspended by cables 34 from inner support base 30. This can be more clearly seen in FIG. 22, a cross section of bed 102. In some embodiments, the roles of inner support base 30 and supported outer base 33 are switched in the sense that the supported base is not on the "outside" but instead on the "inside".

Figure 22:
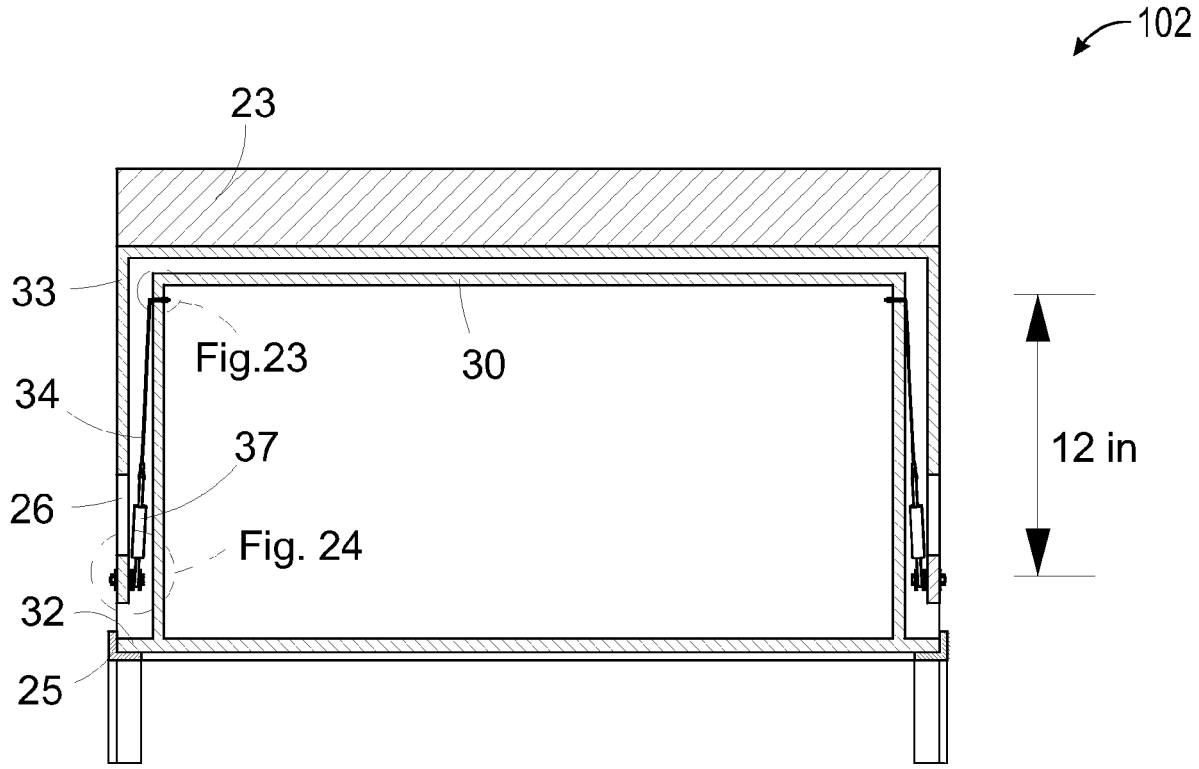
FIG. 22 is an illustration of a cross-sectional view from the foot of a bed apparatus according to an embodiment of the present invention that is referred to herein as "Configuration C", illustrating the supported outer base as suspended by the inner support base using a first force apparatus.
Figure 23:
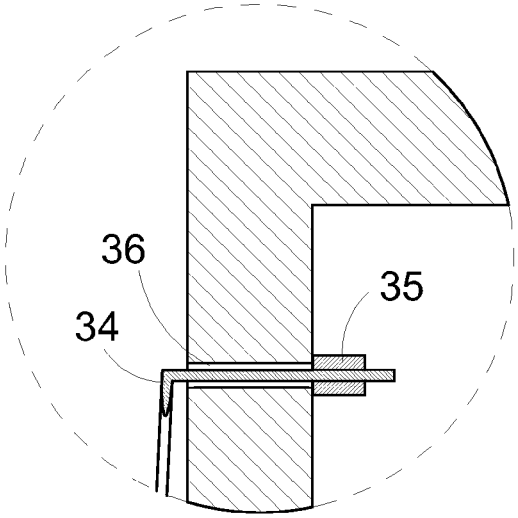
FIG. 23 is a magnified illustration of a bed apparatus according to an embodiment of the present invention that is referred to herein as "Configuration C", illustrating a portion of the inner support base and a first force apparatus.
Figure 24:
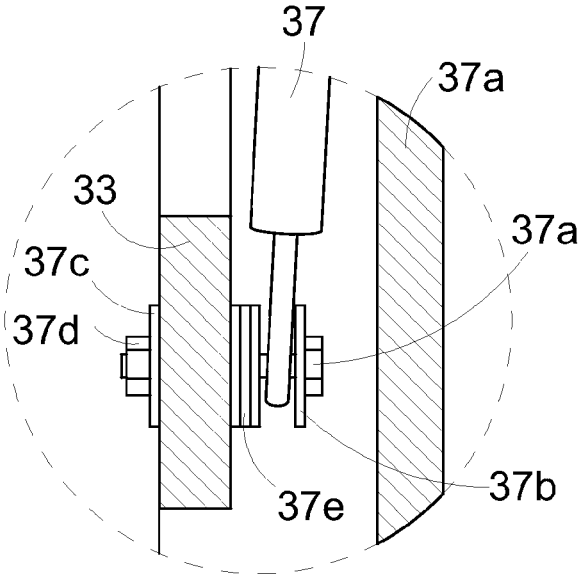
FIG. 24 is a magnified illustration of a portion of the bed apparatus according to an embodiment of the present invention that is referred to herein as "Configuration C", illustrating a portion of the supported outer base and a first force apparatus.

The supported outer base 33 of center bed section 21 is preferably suspended from the inner support base 30 by a plurality of cables 34. Four is a most-preferred number, but more or less can be used. For clarity, only two cables 34 are illustrated in FIG. 19, however, cables exist on both side of the inner support base 30, as can be seen in FIG. 22. Each cable 34 is preferably secured at or near the top of inner support base 30. This can be done in any conceivable manner, but in bed 102 is preferably accomplished by anchor 35, best illustrated in FIG. 23. From its anchor, each cable 34 proceeds through hole 36 in inner support base 30, then travels downward, and is attached to the supported outer base 33 at a position near its lower edge. It can be attached to supported outer base 33 by any conceivable means, but in bed 102 it is preferably attached in the following manner. As perhaps best illustrated in FIG. 24, the downward running cable 34 is attached to the loop of a turnbuckle 37, in the same manner as for bed 100 and bed 101. Turnbuckle 37 is preferably attached to the inner edge of the supported outer base 33 of center bed section 21 by means of a bolt 37*a*, washers 37*b*, 37*c*, and a nut 37*d*. Spacer washers 37*e* preferably ensure turnbuckle 37 has enough clearance to turn without contacting supported outer base 33. Cutouts 26 in supported outer base 33 are preferably placed so as to allow the user access to turn turnbuckles 37, thereby adjusting how supported outer base 33 hangs without disassembling bed 102.

Figure 25:
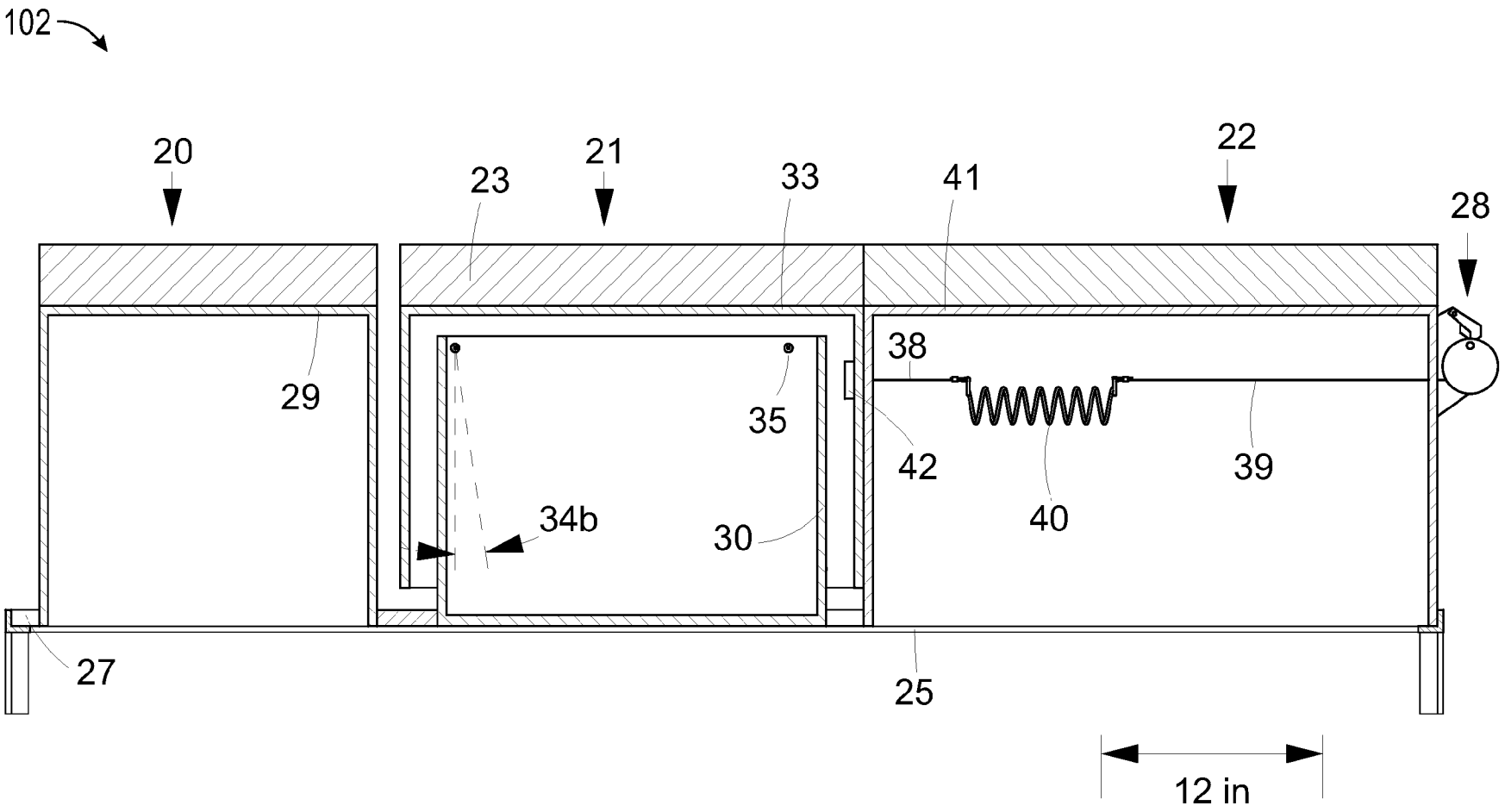
FIG. 25 is an illustration of a cross-sectional side view of a bed apparatus according to an embodiment of the present invention that is referred to herein as "Configuration C"
Figure 26:
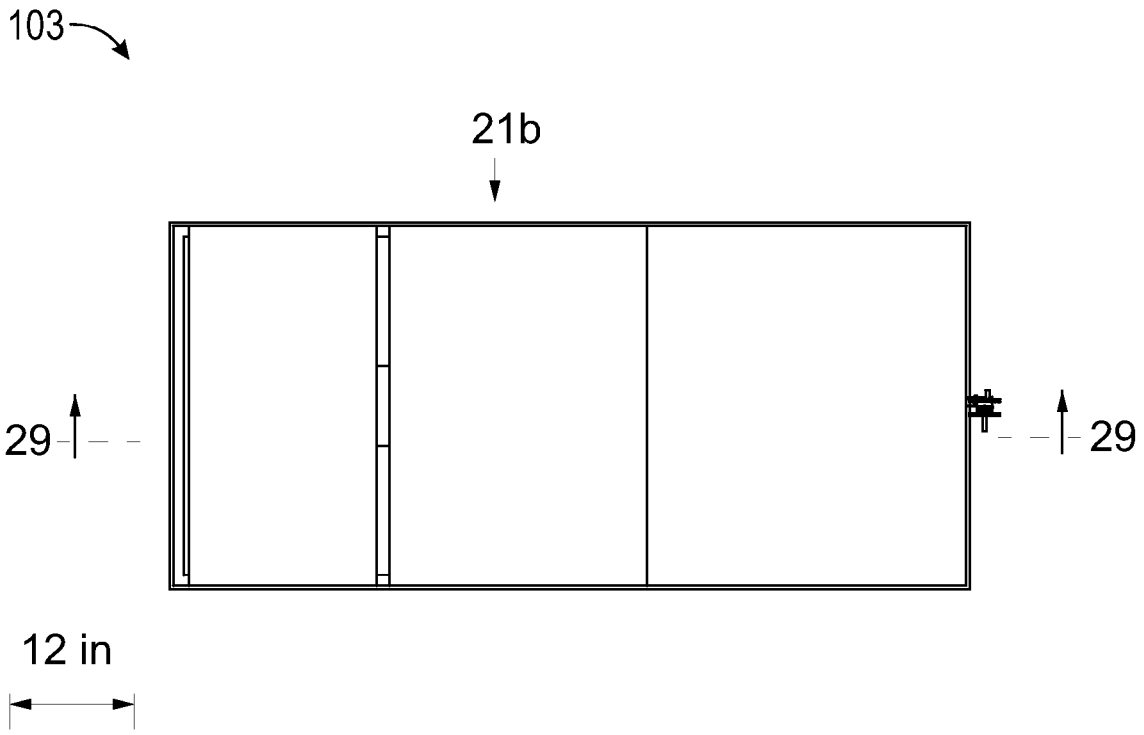
FIG. 26 is an illustration of a top view of a bed apparatus according to an embodiment of the present invention that is referred to herein as "Configuration D"
Figure 27:
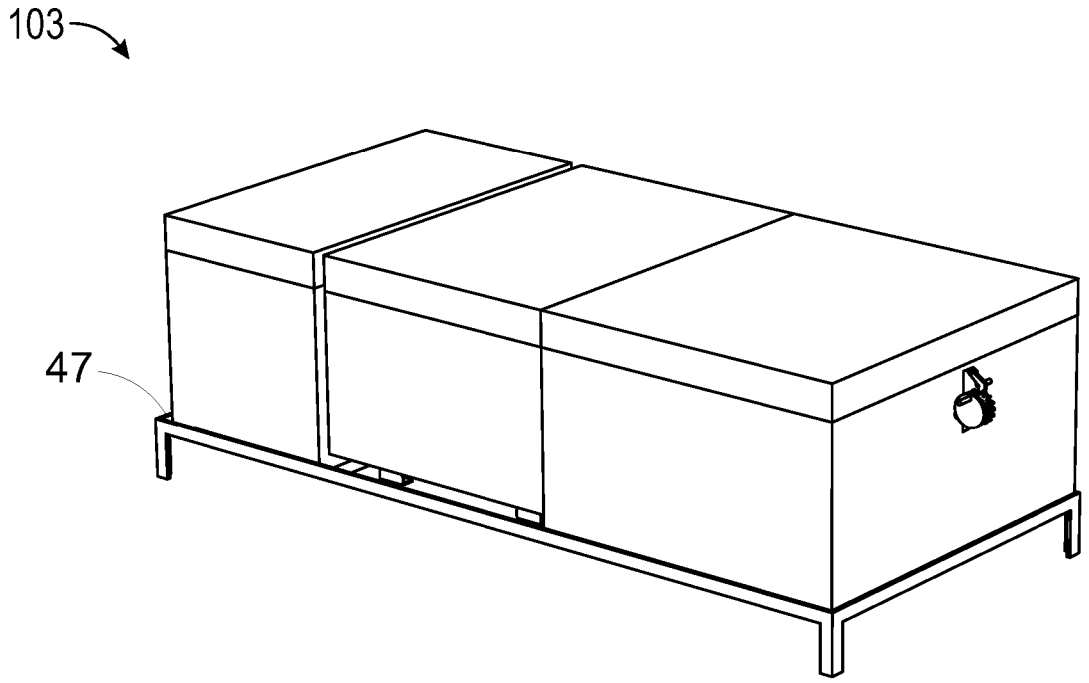
FIG. 27 is an illustration of a perspective view of a bed apparatus according to an embodiment of the present invention that is referred to herein as "Configuration D"
Figure 28:
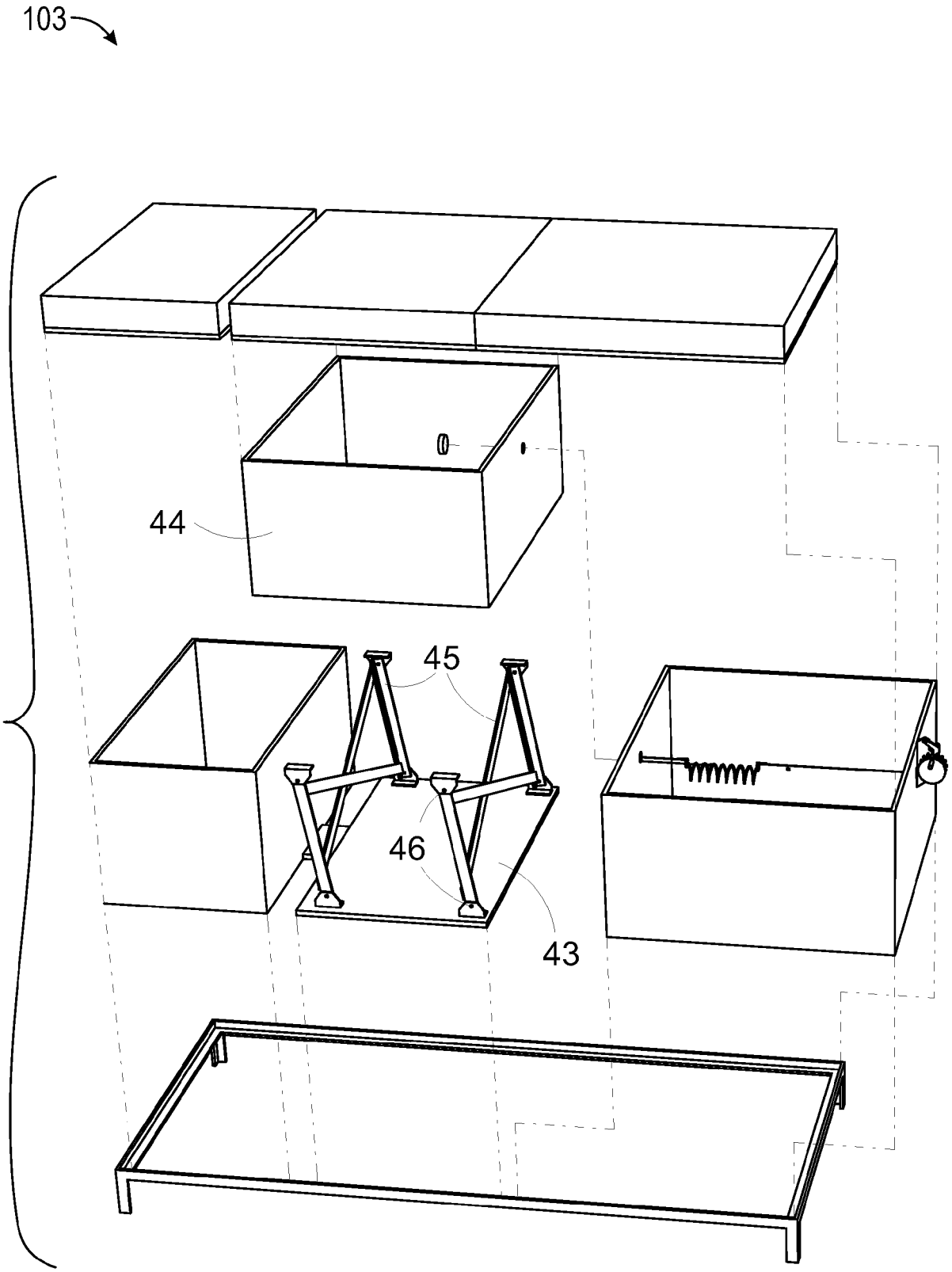
FIG. 28 is an exploded illustration of a perspective view of a bed apparatus according to an embodiment of the present invention that is referred to herein as "Configuration D"

As in bed 100 and bed 101, a restoring force is preferably exerted on center bed section 21 of bed 102 (see FIG. 25) and can be exerted by any conceivable mechanism. Two such mechanisms have already been described above regarding bed 100 and bed 101. FIGS. 19 and 25 illustrate yet another possible mechanism. In this case, the force is exerted on the supported outer base 33 of the center bed section 21. Two cables 38 and 39 are attached to opposite ends of a resilient mechanism, which can optionally comprise spring 40. Cable 38 runs through two holes (illustrated most clearly in FIG. 19), one in the base 41 of the head bed section 22, and one in the supported outer base 33 of center section 21. After passing through these two holes the cable ends at an anchor 42. Cable 39 passes through a second hole in the base 41 of the head bed section 22 and terminates at a ratchet mechanism 28. FIG. 18 perhaps best illustrates ratchet mechanism 28. Ratchet mechanism 28 is attached to base 41 of head bed section 22 by means of a metal mounting piece 28*b*. Cable 39 preferably exits base 41 of head bed section 22 and wraps around a spool 28*a*. To one side of spool 28*a* a crank handle 28*c* is preferably attached. On the other side, toothed gear 28*d* is preferably attached. Toothed gear 28*d* is preferably engaged by catch 28*e* with attached handle 28*f*. By turning spool 28*a*, the user is able to real in cable 39, thereby stretching spring 40, and increasing the tension on wire 38. This increases the restoring force. Catch 28*e* prevents spool 28*a* from unwinding. To decrease the restoring force, the user lifts handle 28*f* of catch 28*e*, thereby lifting the catch and releasing the spool. The user then unwinds spool 28*a* with handle 28*c*. When the restoring force is as desired, catch 28*e* can be re-engaged. In another embodiment, the restoring force may also be applied in the manners described in bed 100 and bed 101, including but not limited to being applied by an elastic band, or by a wire, pulley, and counterweight (see FIGS. 6, 14), or in any other conceivable manner.

Figure 16:
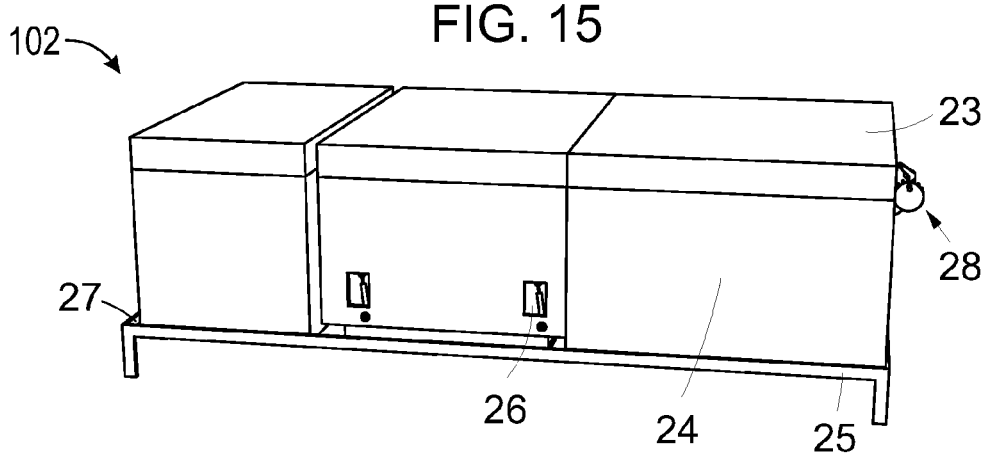
FIG. 16 is an illustration of a perspective view of a bed apparatus according to an embodiment of the present invention that is referred to herein as "Configuration C"
Figure 17:
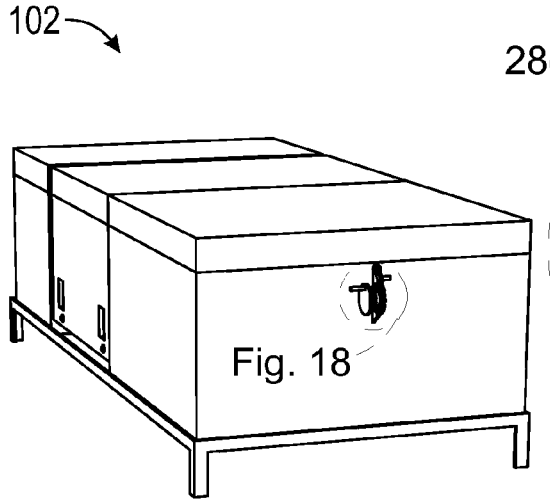
FIG. 17 is an illustration of a perspective view of a bed apparatus according to an embodiment of the present invention that is referred to herein as "Configuration C"

As in bed 100 and bed 101, support cables 34 make angle 34*b* with respect to vertical. In FIG. 25, these cables are hidden behind supported outer base 33, but the angle they make with vertical is labeled 34*b*. In FIGS. 16 and 25, it can be seen that small gap 27 exists between the foot bed section 20 and the end of the rails 25. Gap 27 exists so that if foot bed section 20 is slid backward on rails 25, thus moving backward inner support base 30 as well, the angle support cables 34 make with vertical increases. Conversely, by moving foot bed section 20 forward, the angle increases. As with bed 100 and bed 101, changing the angles the cables make with vertical alters the tractive force exerted on the user's spine: a larger angle results in a larger tractive force and vice versa. This is yet another way to adjust the traction force.

It should be noted that as center bed section 21 moves backwards, spring 40 will stretch more. Thus, the restoring force will increase, and the tractive force will consequently decrease. A longer spring 40 (or an elastic band) will minimize this change in restoring force, but any restoring force that is caused by elastic deformation will suffer this disadvantage. Also, as center bed section 21 moves backwards, angle 34*b* that cables 34 make with vertical decreases, just as in previous configurations. This also causes the tractive force to decrease as the center section displaces toward foot of bed 102.

Configuration D

Figure 29:
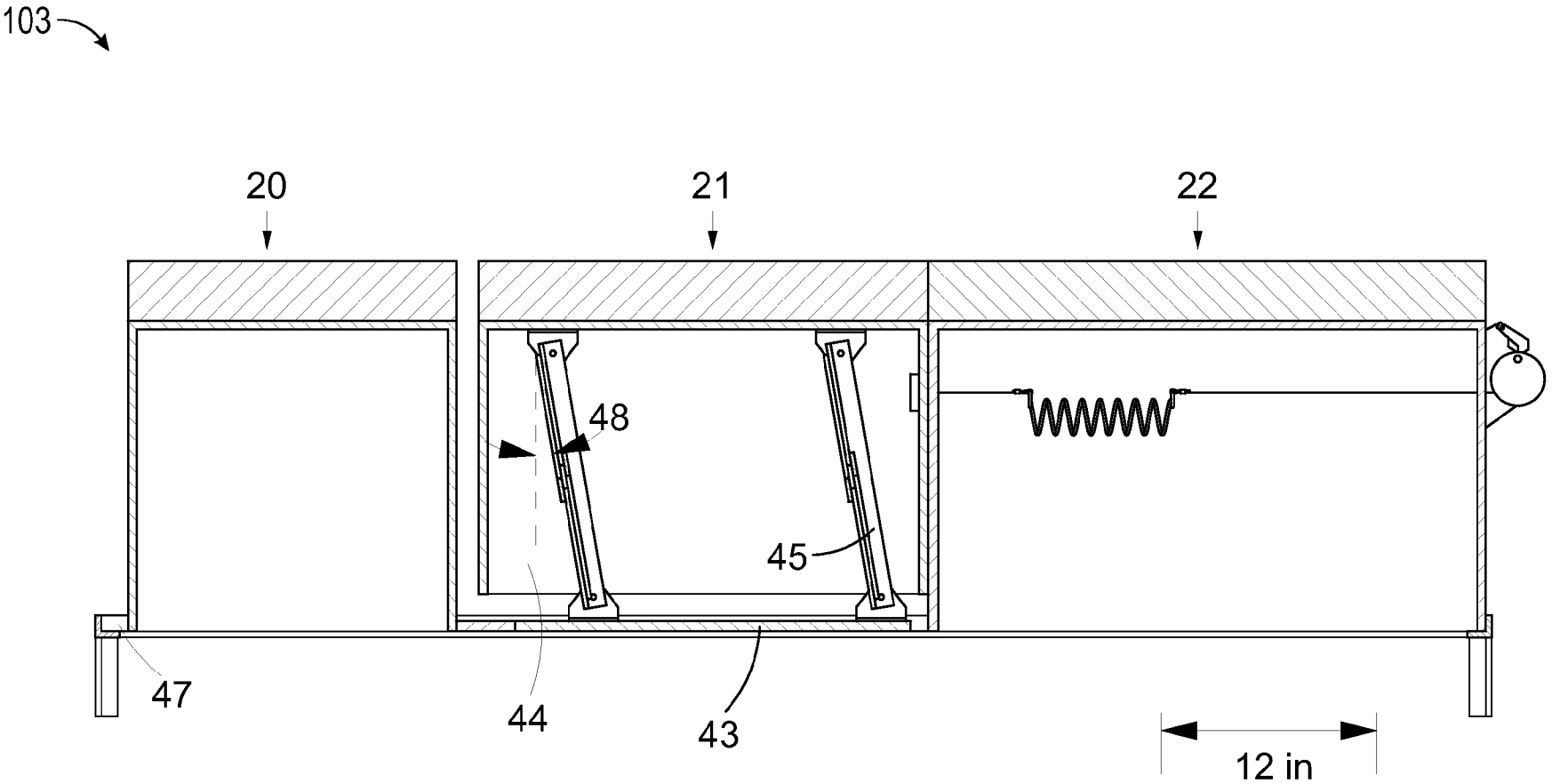
FIG. 29 is an illustration of a cross-sectional side view of a bed apparatus according to an embodiment of the present invention that is referred to herein as "Configuration D"
Figure 30:
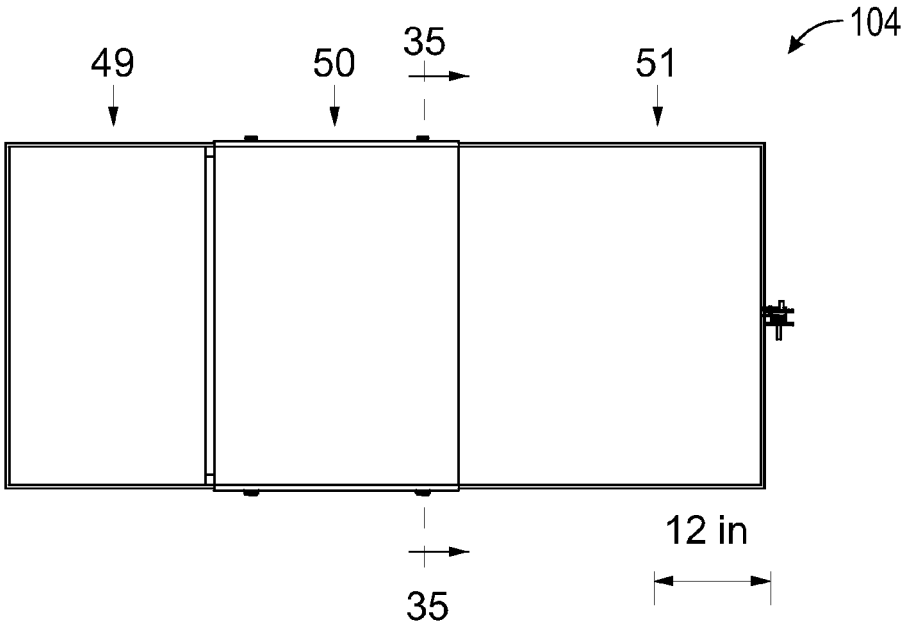
FIG. 30 is an illustration of a top view of a bed apparatus according to an embodiment of the present invention that is referred to herein as "Configuration E"

In yet another embodiment of the present invention, bed 103, is illustrated in FIGS. 26-29 and is referred to herein as Configuration D ("Config. D"). The external appearance of bed 103 looks nearly identical to that of bed 102 and shares most of the same components. The primary difference can be seen in the exploded diagram, FIG. 28. Support base 43 is now preferably connected to supported base 44 by compressional supports 45 rather than by cables. These compressional supports are free to rotate about hinges 46. As can be seen in FIG. 29, these supports make angle 48 with respect to vertical, the same as the cables do in bed 100, bed 101, and bed 102. The forces acting on center section of bed 21*b* can be described by FIGS. 4 and 5, if forces F1 and F5 represent the compressional forces due to the compressional supports (previously, these vectors had represented tensional forces due to cables). It does not matter whether forces F1 and F5 represent tensional or compressional forces - a force is a force and it affects the center section of bed 103 in the same manner. Therefore, all the reasoning previously associated with FIGS. 4 and 5 holds true. Bed 103 is therefore capable of exerting a tractional force on the back, the same as for bed 100, bed 101, and bed 102.

Also, as in bed 102, there exists a small gap 47 (see FIG. 29) between the end of foot bed section 20 of bed 103 and the end of the rails 25. By moving foot bed section 20 of bed 103 backwards, and thus also moving backwards support base 43, the angle the compressional supports 45 make with vertical 48 is decreased. Conversely, by moving foot bed section 20 forward, the angle increases. Changing the angle that the compressional supports make with vertical alters the tractive force exerted on the user's spine: a larger angle results in a larger tractive force and vice versa.

Unlike in bed 100, bed 101, and bed 102, in bed 103 the tractive force increases as center bed section 21 displaces backwards, because angle 48 increases.

Configuration E

In yet another embodiment of the present invention, bed 104, is illustrated in FIGS. 30-36 and is also referred to herein as Configuration E ("Config. E"). Bed 104 is preferably divided into two immobile sections, head 51 and foot 49, and movable center section 50 (see FIGS. 30, 31). Also, similar to bed 102 and bed 103, the sections of bed 104 preferably rest on top of a frame comprising rails 52. The frame is preferably made of a strong rigid material including but not limited to metal (or another suitable material). Unlike in bed 100, bed 101, bed 102 and bed 103, however, in bed 104 rails 52 are not level but rather make angle 53 with respect to horizontal.

Figure 31:
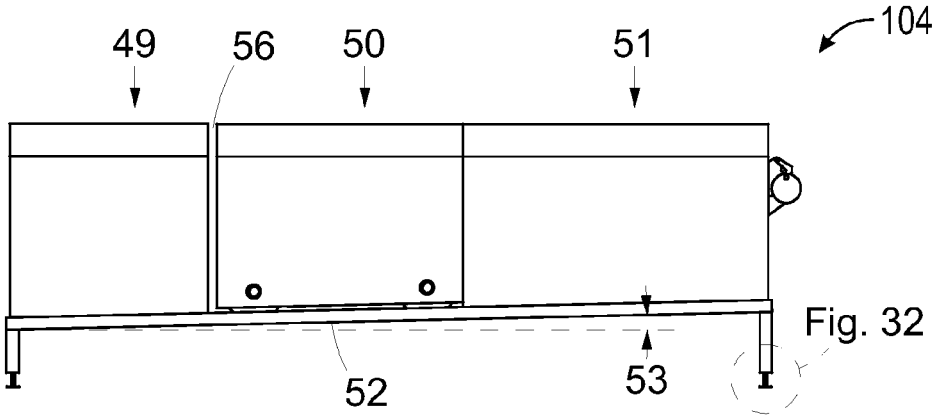
FIG. 31 is an illustration of a side view of a bed apparatus according to an embodiment of the present invention that is referred to herein as "Configuration E"
Figure 32:
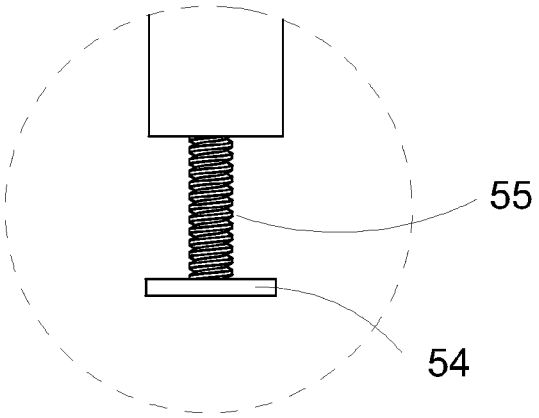
FIG. 32 is an illustration of a magnified view of a portion of the bed apparatus according to an embodiment of the present invention that is referred to herein as "Configuration E", illustrating a portion of the telescoping feet.

Altering angle 53 changes the tractive force, as will become clear in the following description. One preferred way to change this angle is illustrated in FIGS. 31 and 32. Here, rails 52 are preferably positioned above the floor by the use of telescoping feet. Each foot is preferably composed of a footing 54 attached to a threaded bar 55, which screws into a corner of the rails. By turning the foot, the railing is raised or lowered. Screwing in the feet at the head of the bed will decrease the angle 53 the rails make with respect to horizontal; screwing out the feet will increase the angle. At the foot of bed 104, this is reversed: screwing in the feet at the foot of the bed preferably increases the angle the rails make with respect to horizontal, whereas screwing out the feet decreases the angle.

Figure 33:
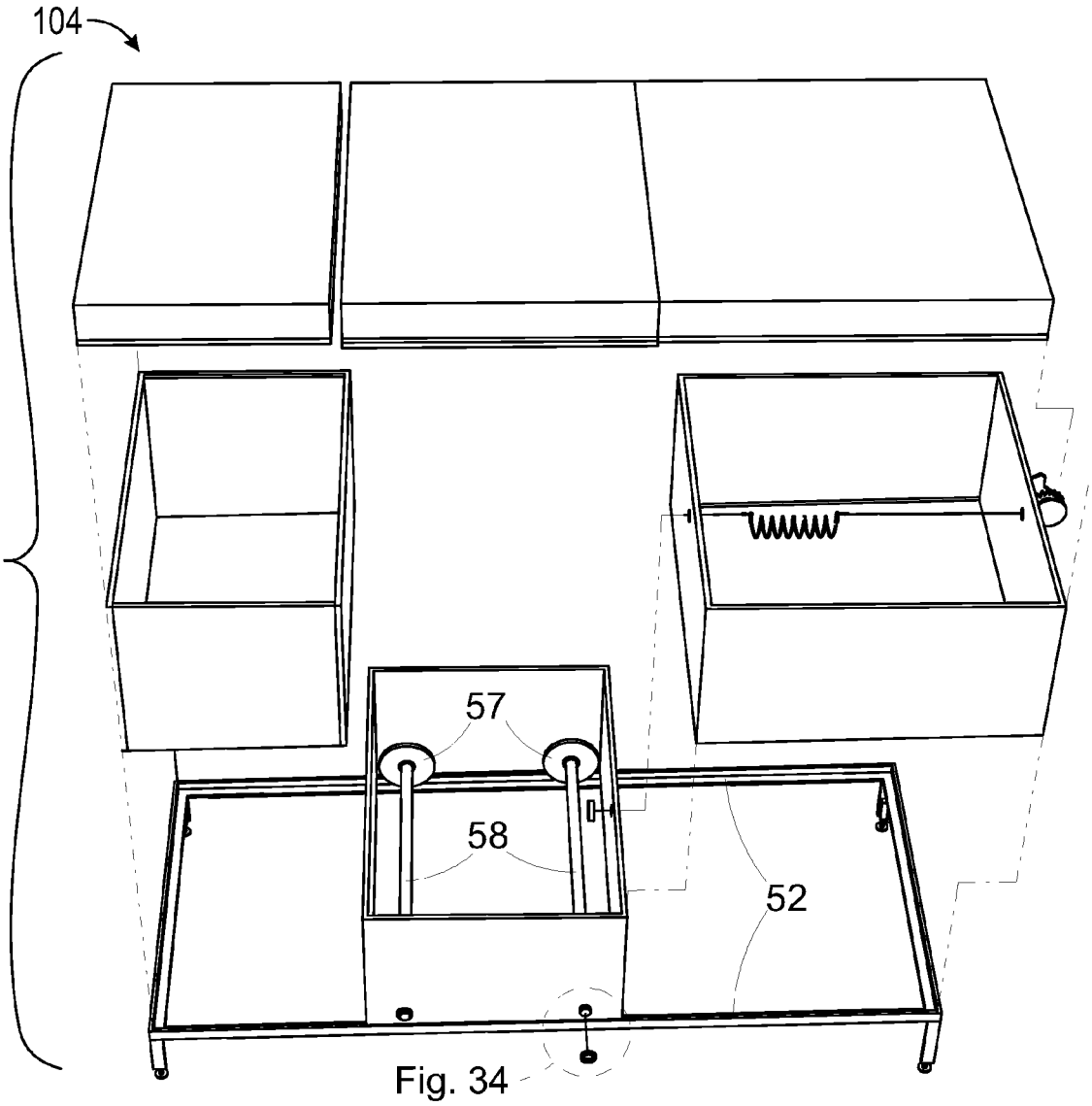
FIG. 33 is an exploded illustration of a perspective view of a bed apparatus according to an embodiment of the present invention that is referred to herein as "Configuration E"
Figure 34:
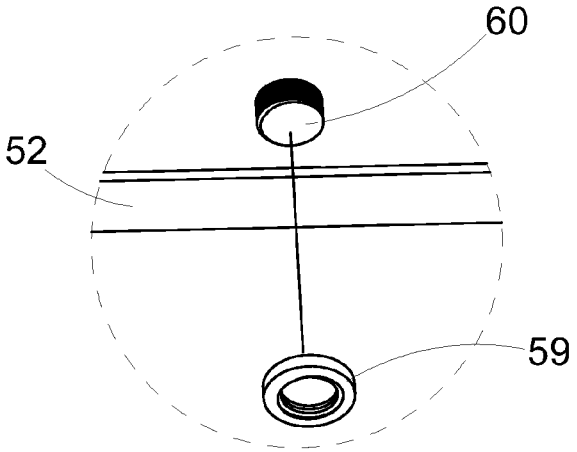
FIG. 34 is an illustration of a magnified view of a portion of the bed apparatus according to an embodiment of the present invention that is referred to herein as "Configuration E", illustrating a portion of the wheels attached to the center bed section.
Figure 35:
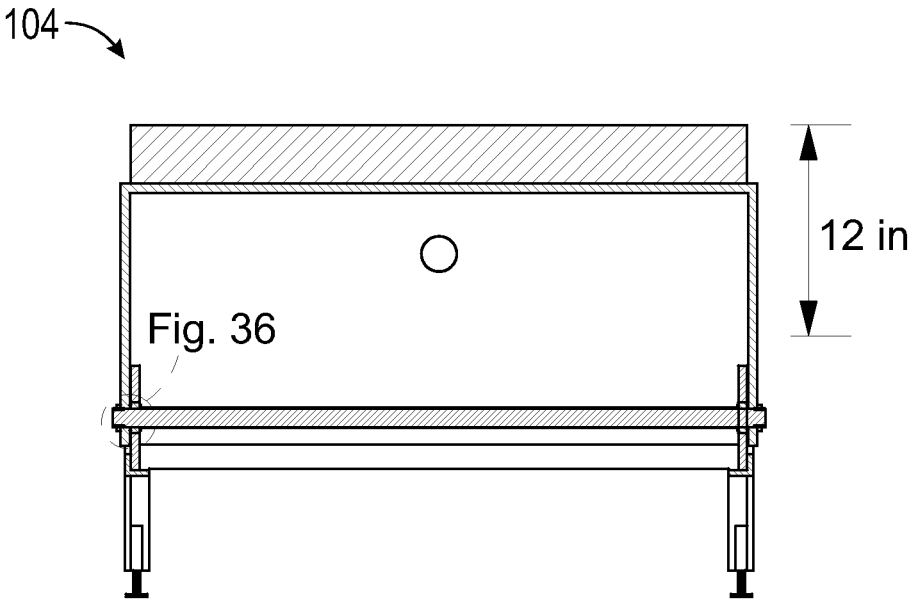
FIG. 35 is an illustration of a cross-sectional view from the foot of a bed apparatus according to an embodiment of the present invention that is referred to herein as "Configuration E"
Figure 36:
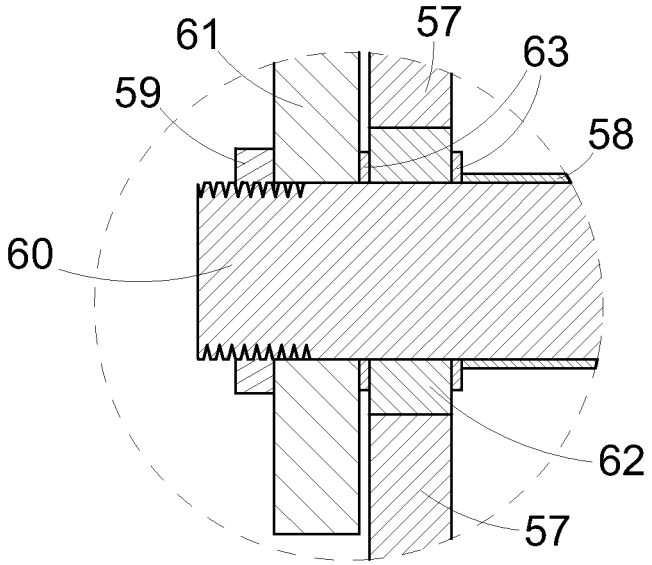
FIG. 36 is an illustration of a magnified view of a portion of the bed apparatus according to an embodiment of the present invention that is referred to herein as "Configuration E", illustrating the relation between the center bed section, wheels and outer bed section.

Attached to center bed section 50 are preferably four wheels 57 (although another number of wheels can also be employed) which are preferably mounted on axles 58. Wheels 57 are one of many possible types of "compressional" supports. As illustrated in the exploded diagram, FIG. 33, wheels 57 preferably roll up and down (most preferably within a very small range of motion) in the inside of rails 52. They are prevented from slipping off rails 52 by flanges on the outside of the rails. If the flanges of rails 52 were on the inside of the bed, rather than the outside, the wheels would roll on the outside of the rails. In this case they would also be prevented from slipping off rails 52. As illustrated in FIG. 33, wheels 57 are preferably mounted to the inside of center bed section 50. This is to prevent bedding from becoming tangled in wheels 57. The wheels may be attached to the center bed section in any desired manner; one such method is illustrated in FIGS. 34-36. In this setup, an inner axle 60 passes through holes in the sides 61 of center bed section 50. Threaded rings 59 on either side of center bed section 50 prevent the inner axle from moving. The wheels 57 are mounted on bearing races 62, which can be of any type. These bearing races are preferably sandwiched between the sides 61 of the outer bed section 50 and an outer axle 58 by washers 63. Outer axle 58 stretches from one side of center bed section 50 to the other and prevents wheels 57 from moving inward.

As in bed 100, bed 101, bed 102 and bed 103, a small gap 56 is preferably left in bed 104 so that center bed section 50 can move forward and back by a small amount (in this case, by rolling on wheels 57). The forces acting on center bed section 50 can be described by FIGS. 4 and 5, if forces F1 and F5 represent the normal forces exerted on wheels 57 by rails 52. All other forces remain as previously described and are exerted by the same mechanisms. Therefore, all the reasoning previously associated with FIGS. 4 and 5 holds true, and bed 104 is capable of exerting a tractional force on the back, the same as for bed 100, bed 101, bed 102, and bed 103.

In bed 104, wheels 57 are what allow the center bed section 50 to move horizontally (and also somewhat vertically). In another embodiment, wheels 57 are omitted, if instead center bed section 50 slid with very little friction on rails 52. For this variation, the frictional force is preferably very small, thus, the use of a lubricant or magnetic levitation is preferably employed. Bearings (friction, ball, roller, etc.) could also be employed to reduce friction.

Because the angle 53 rails 52 make with the horizontal is independent of the position of center bed section 50, the tractive force is not affected in the same way as previous configurations.

Configuration F

Figure 37:
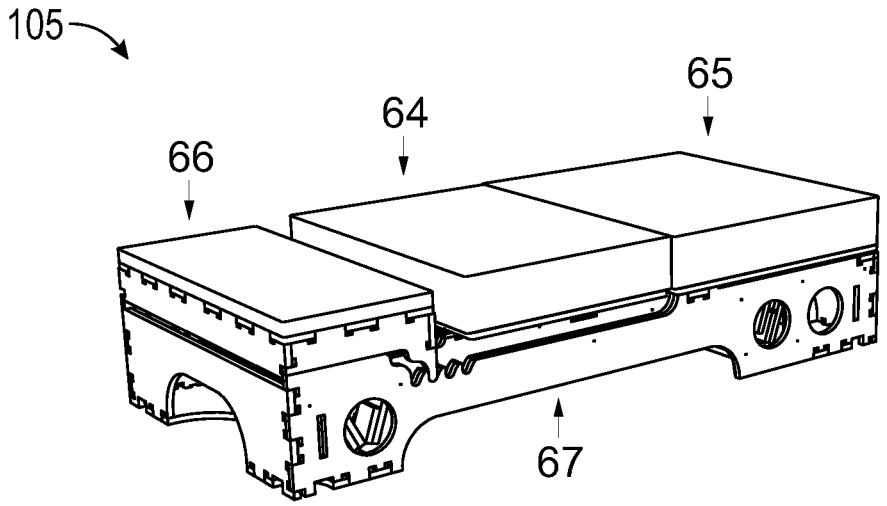
FIG. 37 is an illustration of a perspective view of a bed apparatus according to an embodiment of the present invention that is referred to herein as "Configuration F"
Figure 38:
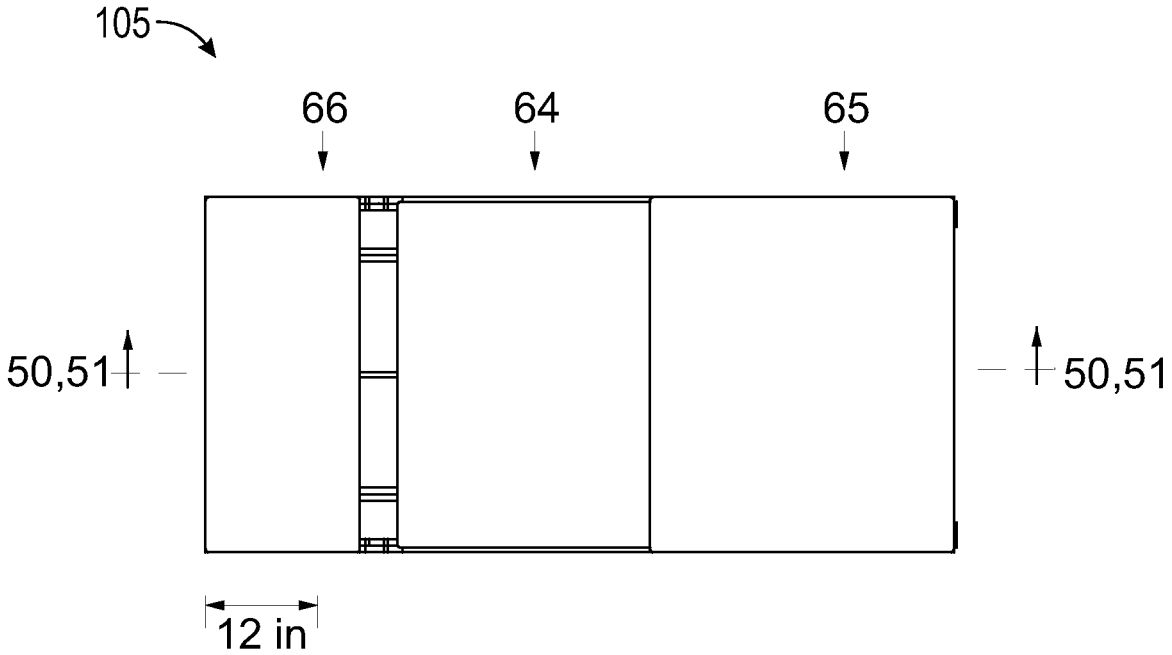
FIG. 38 is an illustration of a top view of a bed apparatus according to an embodiment of the present invention that is referred to herein as "Configuration F"
Figure 39:
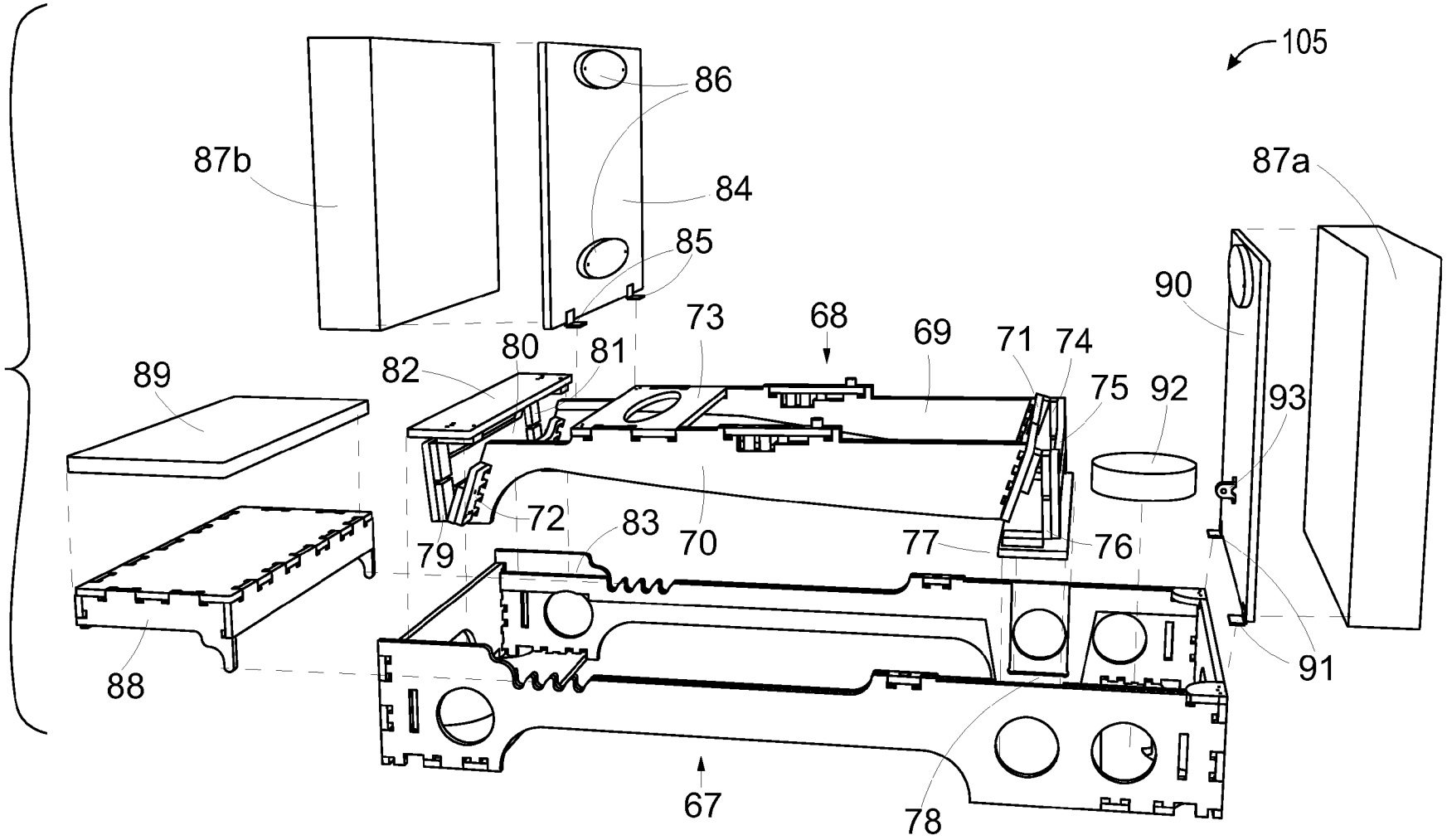
FIG. 39 is an exploded illustration of a perspective view of a bed apparatus according to an embodiment of the present invention that is referred to herein as "Configuration F"
Figure 40:
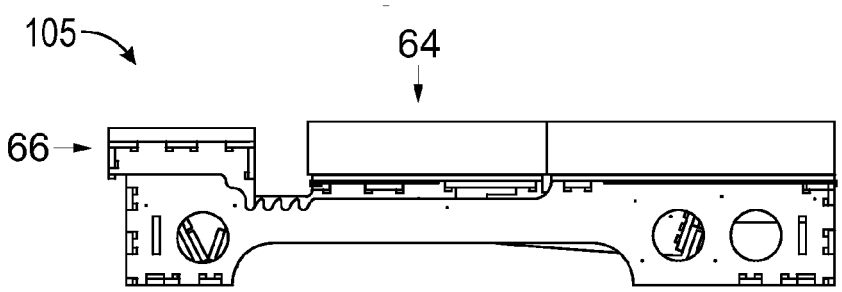
FIG. 40 is an illustration of a side view of a bed apparatus according to an embodiment of the present invention that is referred to herein as "Configuration F", illustrating the foot bed section in a first position.
Figure 41:
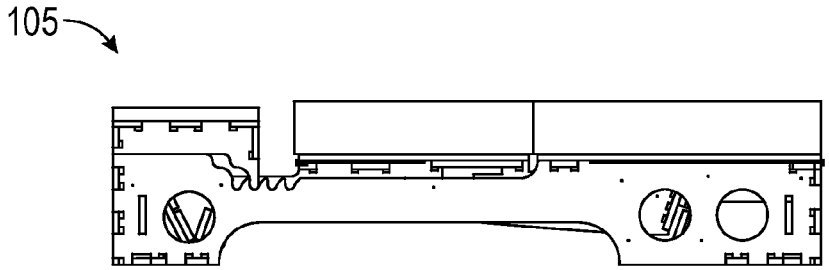
FIG. 41 is an illustration of a side view of a bed apparatus according to an embodiment of the present invention that is referred to herein as "Configuration F", illustrating the foot bed section in a second position.
Figure 42:
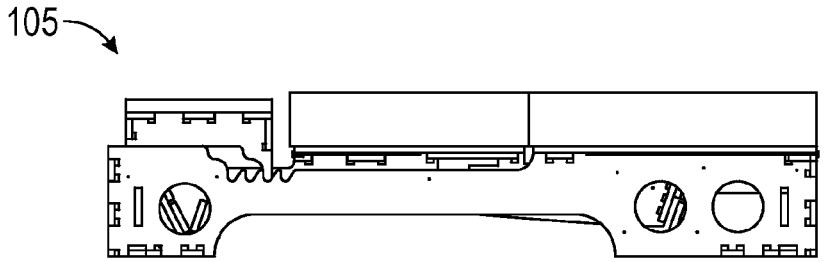
FIG. 42 is an illustration of a side view of a bed apparatus according to an embodiment of the present invention that is referred to herein as "Configuration F", illustrating the foot bed section in a third position.
Figure 43:
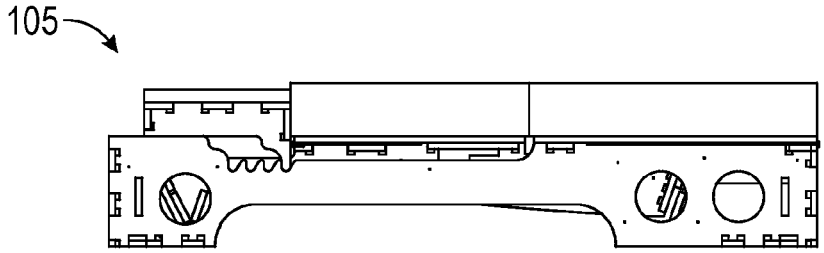
FIG. 43 is an illustration of a side view of a bed apparatus according to an embodiment of the present invention that is referred to herein as "Configuration F", illustrating the foot bed section in a fourth position.
Figure 44:
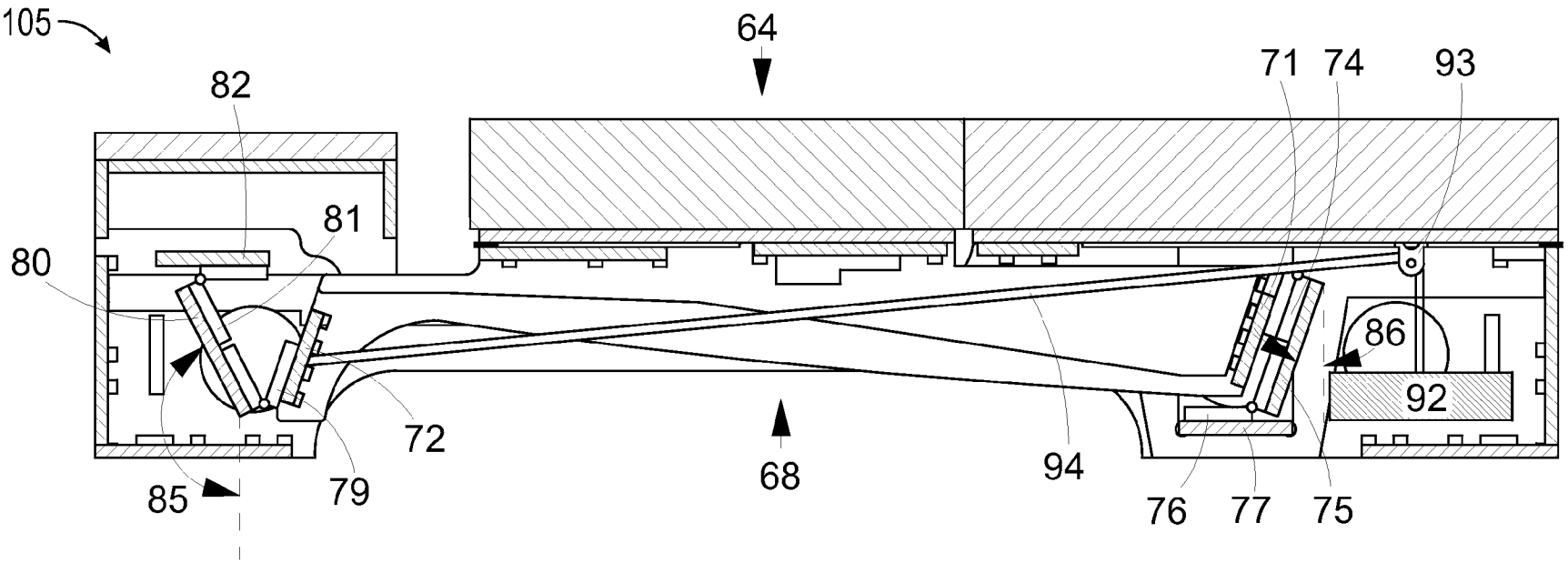
FIG. 44 is an illustration of a cross-sectional view from the side of a bed apparatus according to an embodiment of the present invention that is referred to herein as "Configuration F", illustrating the bed with zero displacement of the subframe and center bed section.
Figure 45:
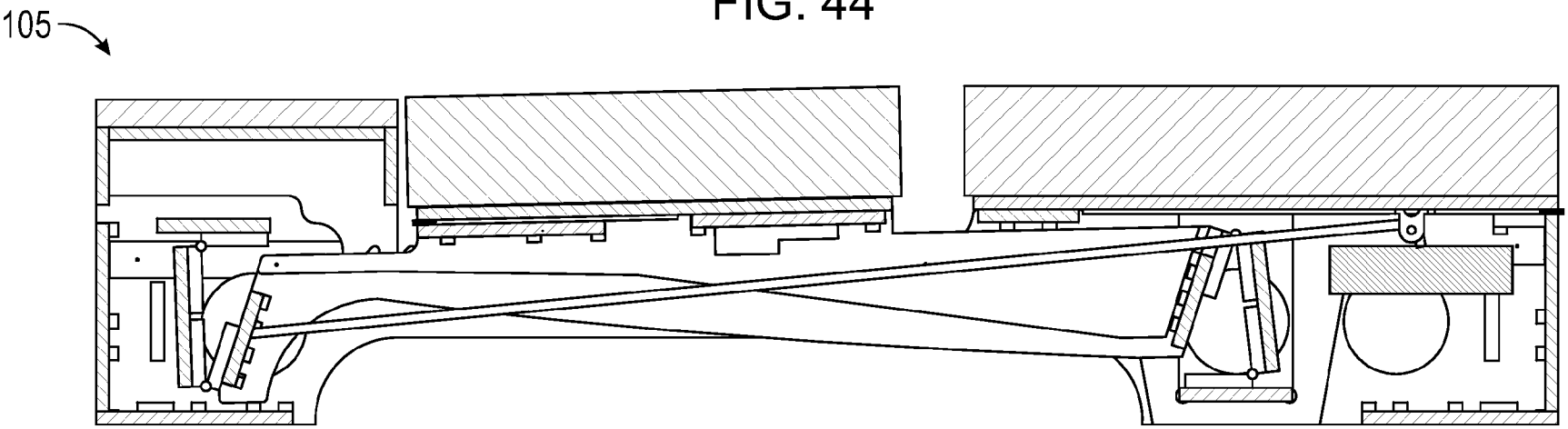
FIG. 45 is an illustration of a cross-sectional view from the side of a bed apparatus according to an embodiment of the present invention that is referred to herein as "Configuration F", illustrating the subframe and center bed section displaced toward the foot of the bed.
Figure 46:
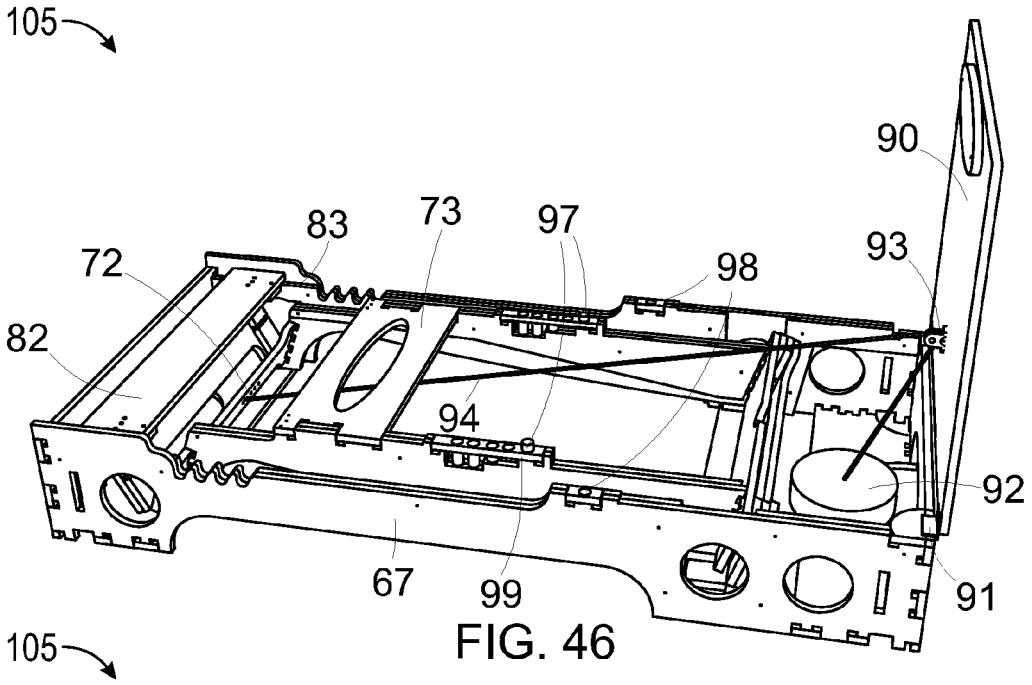
FIG. 46 is an illustration of a perspective view of a bed apparatus according to an embodiment of the present invention that is referred to herein as "Configuration F", illustrating the subframe disposed in the main frame.

Yet another embodiment of a bed according to the present invention is illustrated in FIGS. 37-51. In this embodiment, bed 105 is also referred to herein as Configuration F ("Config. F"). FIG. 37 is a perspective of what the entire assembly of bed 105 preferably looks like. FIG. 38 illustrates what bed 105 looks like from above with the foam mattress pieces removed. FIG. 39 illustrates an exploded view of bed 105. FIGS. 44 and 45 are cross-sections of bed 105, and FIG. 46 illustrates what bed 105 looks like when foot section 66 and center section 64 have been removed.

Bed 105 differs from bed 100, bed 101, bed 102, bed 103 and bed 104 in a number of respects, as follows. First, the entire assembly is configured to be supported by a normal bed frame. Second, center section 64 (see FIG. 38, a top view of the bed assembly without the foam mattress sections) is slightly narrower in width than adjoining head 65 and foot 66 bed sections. As in bed 100, bed 101, bed 102, bed 103 and bed 104, center section 64 is free to move forward and backward within a small range. Lastly, the bed utilizes both compressional and tensional supports to minimize the change in the traction force as the displacement of the center bed section 64 varies.

The bed assembly of bed 105 is preferably configured to fit on a normal bed frame. A twin XL sized bed is illustrated, but other sizes can be built by varying the dimensions of the structural pieces. All other details and functionality preferably remain the same. A twin XL size is a convenient size for a number of reasons. It is long enough to fit most users, yet light enough to be easily transportable. And when placed side by side with another twin XL-sized bed assembly, the footprint is the same size as a king bed. This allows a user to sleep side-by-side with a partner. Because center section 64 of the traction bed is narrower than the rest of the bed, the two beds can be placed side-by-side, or attached to each other (using bolts or another suitable arrangement), but the center section will not contact the neighboring bed, thus allowing bed 105 to operate as intended.

The exploded diagram FIG. 39 illustrates how bed 105 is preferably put together. A main frame 67, approximately the size of a box spring, preferably has solid sides and is braced so as to be strong (see FIGS. 39 and 46). Main frame 67 is preferably made of a strong rigid material, including but limited to wood, metal, plastic, or another suitable material or combinations thereof. Head section 65 preferably includes mattress section 87*a* and solid platform 90 (see FIGS. 37, 39). Platform 90 is preferably attached to the main frame via hinges 91, and can rotate upward, as illustrated in FIG. 46. As best illustrated in FIG. 39, mattress section 87*a* is preferably not permanently attached to the platform, but instead attaches via a mechanism which allows it to be removed, which can include but is not limited to hook and loop fasteners.

Foot section 66 preferably comprises two pieces: platform 88 and a thin mattress section 89 (see FIGS. 37,39). Platform 88 is preferably is most preferably formed from wood. Mattress section 89 is preferably attached to platform 88 by a mechanism which allows for removal, which can include but is not limited to hook and loop fasteners. Preferably, the entire foot section assembly 66 rests on top of main frame 67. FIGS. 40-43 illustrate elevation views of bed 105 from the side. Preferably, foot section 66 can be placed in various positions (four positions is most preferred, but more or fewer positions can optionally be employed). The various positions can be set or provided by position coordinators including but not limited to notches, slots, holes, latching devices, and any combinations thereof. Placing foot section 66 at the rear of bed 105 is helpful for taller users and increases the gap between middle section 64 and foot section 66. This makes it less likely that during the night, center section 64 will contact foot section 66 (if this happens, traction will no longer be exerted). In another embodiment, placing foot section 66 closer to the head of the bed is helpful for shorter users.

Center bed section 64 preferably comprises platform 84, which is most preferably formed from plywood, and mattress section 87*b* which is attached to this platform by hook and loop fasteners (or another suitable method, apparatus, or structure). The platform is preferably attached via hinges 85 to cross-brace 73, which is part of subframe 68 (see FIG. 39). Subframe 68 is preferably formed from of a number of pieces. Two rails, 69 and 70, preferably attach to cross-brace 73, and also to cross members 71 and 72. All these pieces (69, 70, 71, 72, 73) are preferably solidly attached to each other, and can be made of wood or another rigid material. This subframe preferably moves together along with platform 84 and mattress section 87*b*, which are preferably attached via hinges 85.

Subframe 68 is preferably attached via two supports to main frame 67. At the front of the subframe, front cross member 71 is preferably attached via hinges 74 to compressional support 75. This compressional support is preferably attached via hinges 76 to front spanning member 77. At the rear of the subframe, rear cross member 72 is preferably attached via hinges 79 to tensional support 80. This tensional support is then preferably attached via hinges 81 to rear spanning member 82. FIG. 44, a cross section through bed 105, illustrates these connections most clearly.

The two supports (tensional support 80 and compressional support 75) behave very differently. Tensional support 80 is preferably placed in tension, is fixed in place (translationally) at its top, is free to rotate about its top, and its bottom moves in an arc forward and backward. By contrast, compressional support 75 is preferably placed in compression, is fixed at its bottom (translationally), is free to rotate about its bottom, and its top moves in an arc forward and backward. These differences are preferably illustrated most clearly in FIGS. 44 and 45, which are section views of this configuration (FIG. 38 illustrates where these sections are taken). FIG. 44 illustrates bed 105 with zero displacement of subframe 68 and center bed section 64 (which move together), whereas FIG. 45 illustrates bed 105 with the subframe/center section displaced, moved toward the foot of the bed. As illustrated in these figures, angle 85 the tensional support makes with respect to vertical and angle 86 the compressional support makes with the vertical (see FIG. 44) do not change in the same manner. As center bed section 64 moves backward, angle 86 decreases, and can switch signs if the displacement is large enough. This situation is illustrated in FIG. 45, where the compressional support 75 has swung past the vertical. In contrast, angle 85 increases.

Center bed section 64 is preferably constructed so that its center of mass lies halfway between tensional support 80 and compressional support 75, and directly underneath where the user's hips lie. Therefore, the weight of center bed section 64 and user is evenly distributed between the two supports. This happens regardless of the weight of the user. In FIG. 44, compressional support 75 exerts a force on the center bed section 64 which has a horizontal component pointing toward the head of the bed. By contrast, tensional support 80 exerts a force with a horizontal component toward the foot of the bed. Because the sine of angle 85 is greater than the sine of angle 86 (in FIG. 44), the net force (in the horizontal direction) exerted on subframe 68 points toward the rear of the bed. Thus, a tractive force is enacted on the user.

As subframe 68 moves towards the foot of the bed (as in FIG. 45), the horizontal component of the force exerted on subframe 68 by compressional support 75 (which initially points towards the head of the bed) will decrease in magnitude until it is zero. It will thereafter point towards the foot of bed 105, increasing in magnitude as the displacement increases. In contrast, the horizontal component of the force exerted on subframe 68 by tensional support 80, which initially points towards the foot of bed 105, will decrease until it reaches zero. It will thereafter point towards the head of bed 105, increasing in magnitude as the displacement increases. For any given displacement, the change in the force exerted by the tensional member will be offset by the change in the force exerted by the compressional member. The net force will therefore stay approximately constant.

Put another way, assuming angle 86 is small, and the complement of angle 85 is small (they are, which means the small angle approximation is valid), tensional 80 and compressional 75 supports have equal lengths (they do), and that the weight of the users hips/thighs and the weight of the center bed section/subframe (64/68) is evenly distributed between the two supports (tensional and compressional), the change in traction force due to the tensional support will be offset by the change in traction force due to the compressional support.

Even if the ideal conditions outlined above are not met, there will be a smaller variation in the traction force than in a design which uses exclusively tensional or compressional supports, rather than a mix. This is due to the opposite change in the two angles. It now becomes clear why the tensional and compressional supports are located at the ends of bed 105 rather than underneath center mattress section 64: by placing the supports at the ends of bed 105 the weights of the user and center bed section/subframe are distributed more evenly between the two supports, which results in a smaller variation in the traction force as the center section displaces.

Embodiments of bed 105 preferably comprise weight 92, pulley 93, and rope 94 to enact the restoring force (see FIGS. 44-46). Rope 94 is preferably attached to rear spanning member 72. It then travels forward, toward the head of the bed, around pulley 93, then down to weight 92, to which it is connected. The weight rises, as the subframe/center section moves backward, and falls as the subframe/center section moves forward.

Figure 47:
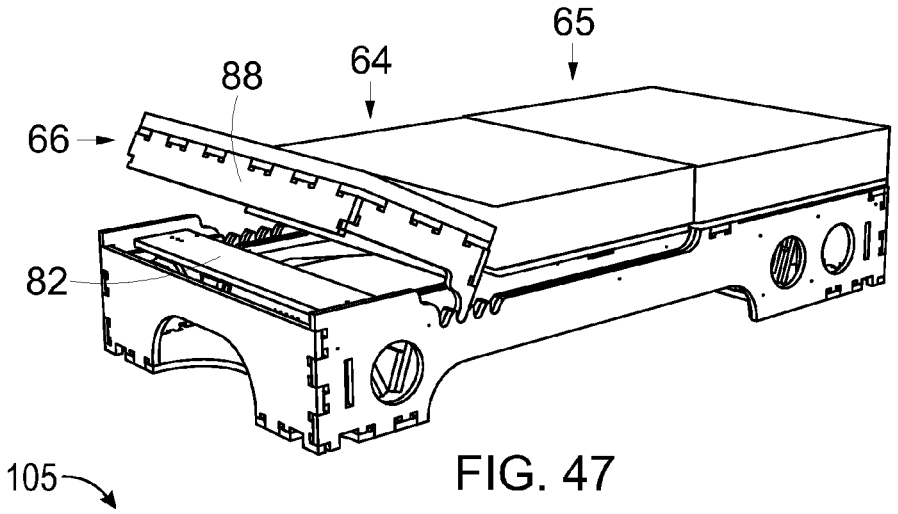
FIG. 47 is an illustration of a perspective view of a bed apparatus according to an embodiment of the present invention that is referred to herein as "Configuration F", illustrating the subframe disposed in the main frame and illustrating how the foot bed section can be positioned and oriented to allow access to the slat.

Embodiments of bed 105 can also be provided with various devices and designs to alter the geometry and function of bed 105 that permit the user to adjust the bed in various ways. In one embodiment, rear spanning member 82 can be moved forward to decrease traction, or backward to increase traction. If the user moves this slat all the way forward no traction will be exerted and bed 105 will behave as a normal bed would. The rear slat can be held in place by toothed gear racks, hook and loop fasteners, rubber pads, or any other suitable mechanism, structure, or method. To access the slat, the user can remove foot section 66 by lifting it off of bed 105. Easier still, he or she may simply rotate the foot section, as illustrated in FIG. 47. This allows the user to alter the traction without having to remove bedding or remake bed 105.

In another embodiment which provides yet another adjustment for the user, the gap between foot section 66 and center section 64 can preferably be adjusted, as described in more detail above. Ideally, this gap is preferably large enough so that center section 64 does not come in contact with foot section 66 during the night. If this occurs traction will no longer be exerted on the user's back.

Figure 48:
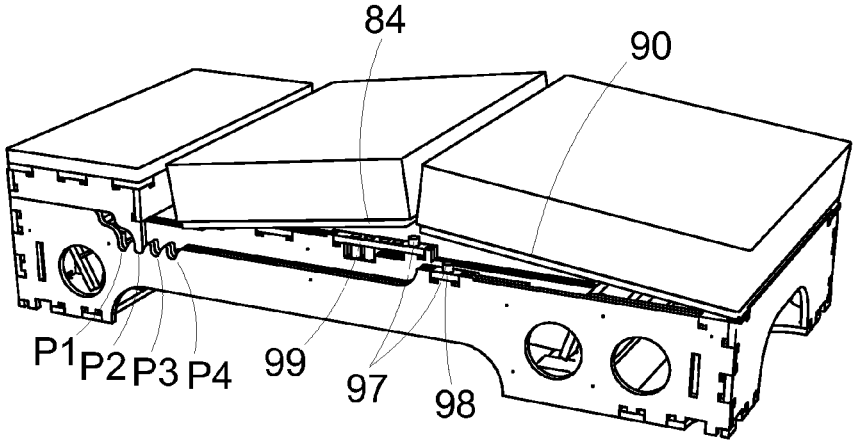
FIG. 48 is an illustration of a perspective view of a bed apparatus according to an embodiment of the present invention that is referred to herein as "Configuration F", illustrating the subframe disposed in the main frame and illustrating how the center bed section and head bed section can be positioned and oriented in relation to each other as an adjustment to raise the center seam for comfort or for straightening the user's spine.
Figure 49:
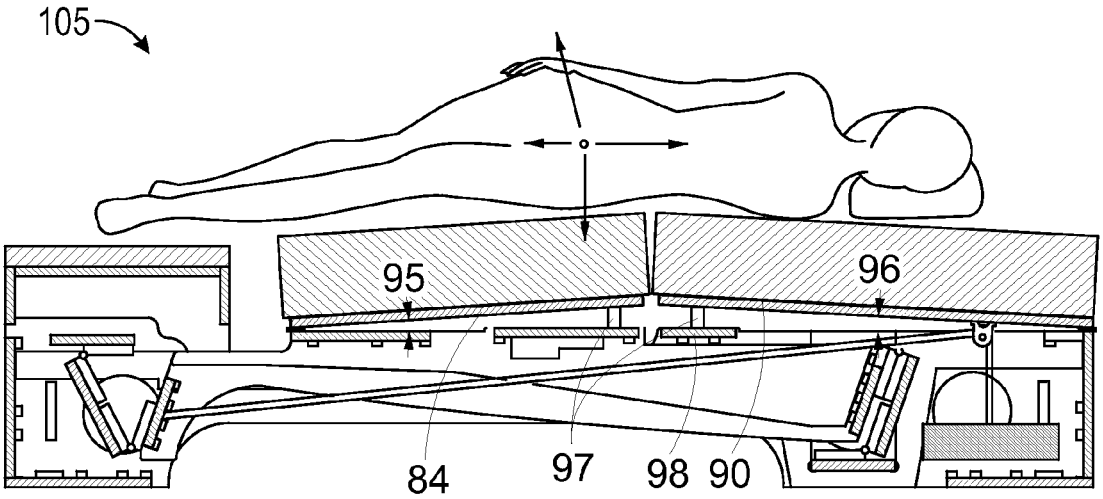
FIG. 49 is an illustration of a cross-sectional side view of a bed apparatus with a user laying on it according to an embodiment of the present invention that is referred to herein as "Configuration F", illustrating the subframe disposed in the main frame and illustrating how the center bed section and head bed section can be positioned and oriented in relation to each other as an adjustment to raise the center seam for comfort or for straightening the user's spine.
Figure 50:
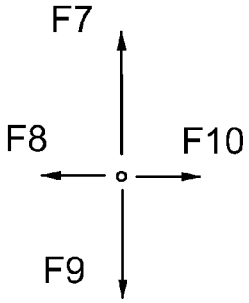
FIG. 50 is a free body diagram illustrating the forces acting on a user's hips when all bed sections of a bed apparatus are horizontally oriented in relation to each other creating a flat bed surface, according to an embodiment of the present invention that is referred to herein as "Configuration F"
Figure 51:
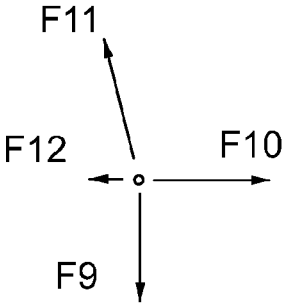
FIG. 51 is a free body diagram illustrating the forces acting on a user's hips when the center bed section and head bed section are inclined in relation to each other creating a raised seam in the bed surface, according to an embodiment of the present invention that is referred to herein as "Configuration F"
Figure 52:
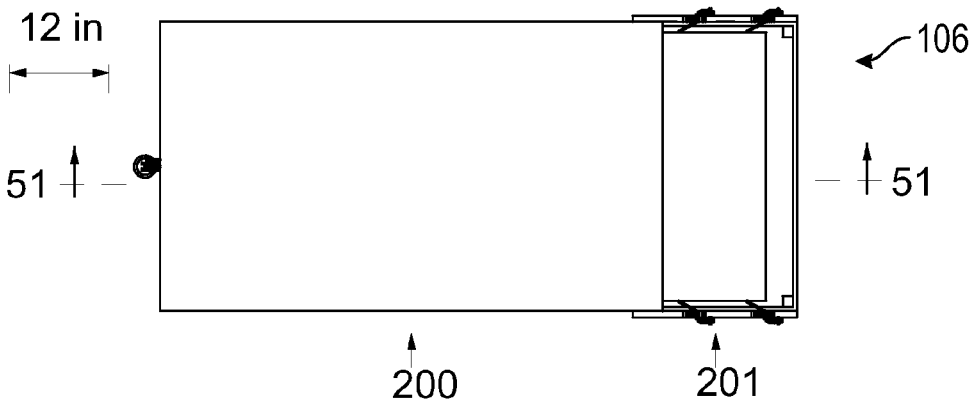
FIG. 52 is an illustration of a top view of a bed apparatus according to an embodiment of the present invention that is referred to herein as "Configuration G"
Figure 53:
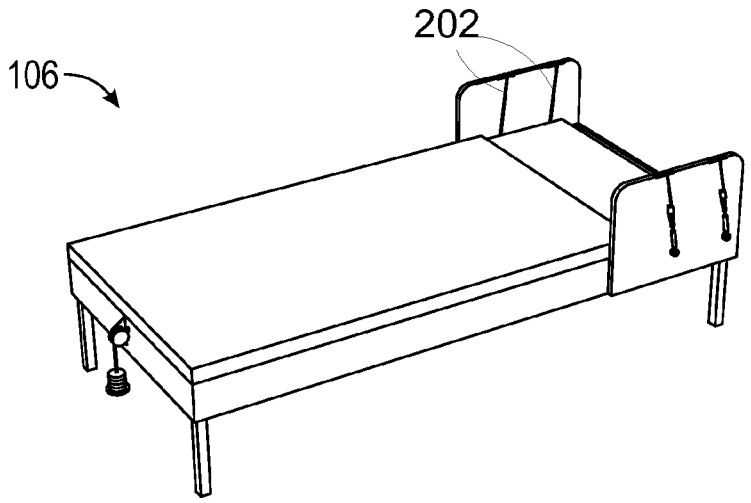
FIG. 53 is an illustration of a perspective view of a bed apparatus according to an embodiment of the present invention that is referred to herein as "Configuration G"

In yet another embodiment that provides another adjustment for the user, center section 64 and head section 65 are preferably rotated slightly so as to raise the seam between them (see FIG. 48, in which this rotation is exaggerated). This is useful for two reasons. First, this modification straightens the spine, particularly when the user is sleeping on his/her side; raising the seam raises the waist, preventing this area from slumping into the mattress. Second, for a given amount of traction force, raising the center seam decreases the friction forces exerted on the user's torso and hips/thighs, which increases comfort and reduces the rolling of the hips - again, keeping the spine straight. This can be seen from FIG. 49, and the free body diagrams ("FBD") FIGS. 50-51 representing the forces applied to the user's hips/thighs when using bed 105 (as illustrated in FIG. 49). FIG. 50 illustrates the FBD for the hips, for the case where all sections are oriented horizontally (angles 95 and 96 in FIG. 49 equal zero). In this case, F9 represents the force of gravity, F7 the normal force on the hips due to the mattress, F8 the frictional force on the hips/thighs due to the mattress, and F10 the tensional force on the hips exerted by the spine. At equilibrium, F8 and F10 have the same magnitude. FIG. 51 illustrates the FBD for the hips, in the case where the center and head sections are inclined somewhat. In this case, the normal force F11 is also inclined somewhat and has a horizontal component which points towards the foot of bed 105. In equilibrium, the sum of this component and force F12 has the same magnitude as F10. For a given magnitude of F10, therefore, F12 decreases in magnitude as angle 95 increases. The frictional force exerted on the body can therefore be reduced for a given magnitude of traction, thus increasing the user's comfort. Or similarly, for a given magnitude of friction the magnitude of the traction force can be increased by increasing angle 95. The same principles hold for the upper body as well: for example, by increasing angle 96, the frictional force exerted on the user's upper body can be decreased for a given magnitude of traction force. Angles 95 and 96 can be made adjustable to fine-tune bed 105 for the user's comfort. FIGS. 48 and 46 illustrate one method of accomplishing this: high durometer rubber blocks 97 of varying heights are preferably stored in mounting holes in a holder 99 attached to subframe 68. Rubber blocks 97 can preferably be removed from holder 99. Rubber blocks 97 when placed in holder 99 preferably hold up platform 84 of the center mattress section (see also FIG. 49). Rubber blocks 97 can also be placed in mounting holes in a holder 98 attached to the main frame to raise platform 90 of the head mattress sections. The mattress sections and their platforms can also be held at the desired angle by any of numerous mechanical devices, including, for example, shims of varying heights, hydraulic mechanisms, etc.

In bed 105, foot mattress section 89 (see FIG. 39) is preferably not as deep as the center and head mattress sections 87*b* and 87*a*. To maintain the upper surface of this mattress section at the same height as the other sections (to maintain sleeping comfort), the mattress is preferably raised (see FIGS. 40-43). There is a distinct advantage to this design: when the user raises his or her hips to reset bed 105, as described before, his weight is supported by only the head 87*a* and foot 89 mattress sections. Therefore, at these times, these sections support a greater weight than when the user is lying flat on bed 105. As the mattress sections are compressible, they therefore compress to a greater degree when the user raises his or her hips. By reducing the depth of the foot mattress section 89 the mattress compresses less in these circumstances. Therefore, the user does not need to raise his/her hips as high in order for the hips to clear (not touch) the center mattress section 87*b*. Furthermore, foot mattress 89 does not need to be thick, because when the user is lying flat, there is not much weight on this mattress section (only the weight of the feet needs to be supported). By contrast, the head mattress section 87*a* must be thicker, as more padding is required to comfortably support the user's torso and head.

Variations on bed 105 can be made which are just as functional. One variation consists of placing tensional support 80 at the head of the bed, and the compressional support 75 at the foot of the bed. The movable spanning member is therefore at the head of the bed and can be adjusted by lifting head mattress section 65 and moving said member forward and backward. The movable spanning member can be anchored in place by hook and loop tape, mating teeth, etc. Traction could also be adjusted by moving the front spanning member 76, rather than rear spanning member 82, although this would likely be less convenient. Other variations can include changing the way the restoring force was generated. All options discussed above (spring, elastic band, etc.) can also be employed.

Configuration G

Yet another embodiment of a bed according to the present invention is illustrated in FIGS. 52-56. In this embodiment, bed 106, which is also referred to herein as Configuration G ("Config. G"), utilizes forces similar to the set of forces introduced in FIGS. 4 and 5, and the same construction methods employed in bed 100 and bed 101, to place the cervical spine (rather than the lumbar spine) in traction. Bed 106 is preferably divided into two parts: body section 200 on which the user's body from the neck down lies, and the head section 201, upon which rests the user's head. Body section 200 is preferably fixed and head section 201 is preferably movable. As in bed 100, bed 101 and bed 102, the movable section of bed 106 is preferably suspended by cables 202 which make angle 203 with respect to vertical (see FIG. 56). A restoring force is preferably placed on movable head section 201 by a cable 207, pulley 205, and weight 208 system. The restoring force can also be caused by one of the other arrangements discussed in bed 100, bed 101, bed 102, bed 103, bed 104 and bed 105, or by another suitable arrangement.

Figure 54:
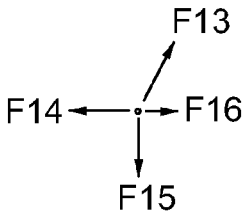
FIG. 54 is a free body diagram illustrating the forces acting on the head bed section of a bed apparatus according to an embodiment of the present invention that is referred to herein as "Configuration G", illustrating the forces applied when the user's head is not lying on the section but is lifted off the section.
Figure 55:
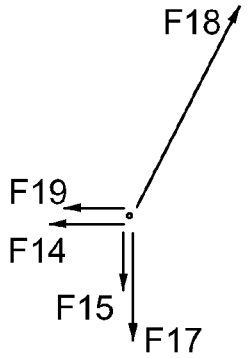
FIG. 55 is a free body diagram illustrating the forces acting on the head bed section of a bed apparatus according to an embodiment of the present invention that is referred to herein as "Configuration G", illustrating the forces applied when the user's head is in contact with and supported on the section.
Figure 56:
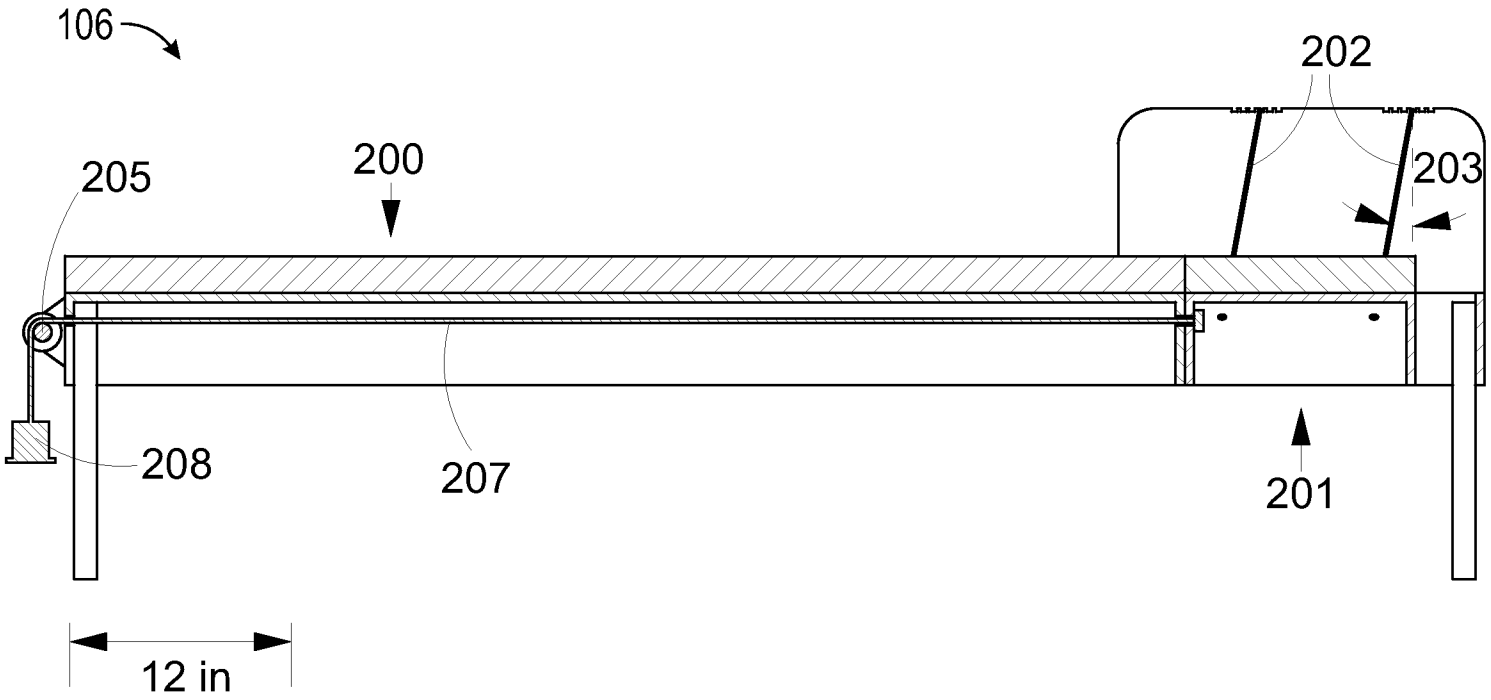
FIG. 56 is an illustration of a cross-sectional side view of a bed apparatus according to an embodiment of the present invention that is referred to herein as "Configuration G".

FIGS. 54 and 55 illustrate the forces acting on movable head section 201. If the user lifts his/her head off of head section 201, the forces are as illustrated in FIG. 54. These forces include the weight of movable section F15, net tensional force F13 due to the four support cables, restoring force F14, and normal force F16 exerted on the movable head section by the fixed body section. When the user rests his or her head on movable head section 201, the forces are as illustrated in FIG. 55. The user's head (or pillow, if a pillow is placed between the movable head section 201 and the user's head) exerts normal force F17 on the movable section. To maintain equilibrium, the net force in the vertical direction must remain zero. For this to occur, the vertical component of the net tensional force F18 must increase; so too then, it's horizontal component must also increase. In order for the net horizontal force to remain zero, new force F19 must be exerted on the movable section: this is the frictional force exerted on movable head section 201 by the user's head (or pillow). Because the user's head exerts a frictional force on movable head section 201, by Newton's third law, the movable section must also exert a frictional force on the user's head in the opposite direction. This force points in the opposite direction as F19 and is therefore a tractive force which pulls the user's head toward the head of the bed. Therefore, when the user rests his or her head on movable head section 201, the user's cervical spine is placed in traction. And as with the configurations which place the lumbar spine in traction, the user can lie in any position - on his or her back, sides, and stomach - in all cases the tractive force is still applied. In practice, when the user rests his or her head on movable head section 201, a small gap will appear between the movable head section and fixed body section 200. When the user lifts his or her head, the restoring force pulls the movable head section back toward the fixed body section, until the two rest against each other. Therefore, lifting his or her head, the user resets the bed, and any gap between the two bed sections is closed.

Bed 102, bed 103, bed 104 and bed 105 look more like a normal bed because they do not have support panels raised above the level of the bed. These designs can be adapted to place the cervical spine in traction as well. As doing so is straightforward given the in-depth descriptions of bed 102, bed 103, bed 104 and bed 105, drawings of such arrangements are not provided.

Lastly, cervical traction functionality (in the manner described above) can be added to any of bed 101, bed 102, bed 103, bed 104 and/or bed 105, so as to put both the lumbar and cervical spines in traction. In such variations, there is preferably four mattress sections: the foot and thoracic (trunk) sections are preferably fixed in place, but the head and hip/knee sections are preferably free to move by a small amount.

Motorized Embodiments

Each of the embodiments of the present invention described herein can also comprise other apparatuses for applying the suspending, supporting, restorative, or traction forces applied to the movable or center sections of the various beds, including but limited to motors or other mechanisms such as hydraulic mechanisms. The configurations heretofore discussed have not employed any electrical components. These bed configurations (hereinafter "mechanical only" designs) are quiet, do not need to be placed near a power outlet, and would work during a power outage or in an off-grid residence. These are advantageous features, but certain advantages can be gained by employing electrical components. For example, one downside inherent to the mechanical only designs is that they require some action by the user to let the restoring force do its job. The user allows the center bed section to move forward by raising his/her hips, or scooting them forward (towards the head of the bed). In practice, this is not a great burden for most people, but for the infirm or overweight, it may prove difficult. This problem is solved by electrifying the bed. Electrifying the bed mechanism can make using the traction bed no different than sleeping on a normal bed.

Basic Electrified Configuration

The electric system can take many forms. One embodiment (referred to herein as the "Basic Electrified Configuration") preferably comprises the following components.

1) One or more sensors preferably detect movement of the user on the bed (for example, while changing sleeping positions). These sensors include but are not limited to pressure sensors, strain sensors, vibration sensors, infrared imaging sensors, etc. Pressure sensors are most preferred. For example, unlike vibration sensors, pressure sensors are not affected by the movement of a sleeping partner in an adjoining bed, and they are less expensive than any kind of imaging sensor. The pressure sensor can be employed anywhere in the bed design where it will support a portion of the user's weight. Referring to FIG. 46 (Config. F), one or more pressure sensors are preferably placed underneath the rubber blocks 97 placed in holders 98 and/or 99. When the user is at rest (that is, not changing sleeping positions) the sensor(s) registers no change in activity. When the user is moving, changing activity is registered. An electrical signal(s) is sent from the sensor(s) to the next component of the electrical system, a signal processing unit.
2) A signal processing unit to interpret signals coming from the sensor(s). This unit preferably comprises discreet logic, medium-scale-integration chips (MSI), a microcontroller, a programmable logic device, or a microprocessor. An MSI solution or microcontroller is most preferred. The processing unit determines whether the sensor is detecting user movement or not. If it detects movement, it sends a signal to the next component in the system, discussed next.
3) A device which controls an electric motor. It could be as simple as a power transistor (or power transistor array), or as complex as a motor controller. This device is preferably activated when "told" to do so by the signal processing unit. If the component is a power transistor, it is activated by a particular voltage level. A more complex device, such as a motor controller, may require a digital signal to control it. The motor controlling component is connected to the next component in the system, an electric motor.
4) An electric motor. The preceding three components determine when the electric motor is turned on. It is turned on whenever the user moves. This electric motor could be a DC motor (brushed or brushless) or AC motor. If it is a DC motor, it can be turned on by a power transistor. An AC motor needs a motor controller. The electric motor is preferably attached mechanically to the center section, such that when it is turned on it increases the restoring force. Preferably, the method of connection is as follows: a cable or rope runs from the center bed section (or subframe, in Config. F) to a pulley. The pulley is connected to the electric motor either directly, or through a one-speed gearbox.

If the electrical components are set up as described above, whenever the user moves his/her body, the restoring force is increased. This helps ensure that the center bed section does not move (or moves only towards the head of the bed) when the user is shifting positions. When the user stops moving, the electric motor turns off, and traction is applied.

The restoring force is increased by the electric motor, but even if the electric motor is turned off, a static restoring force is still preferably applied by one of the mechanisms discussed previously (a weight and pulley, elastic band, spring, etc.). This guarantees that when the bed is not in use, the center section is pulled towards the head of the bed, so that that the bed is ready for the user to lie down on at any time. Otherwise, the motor would need to be turned on all day long. This would decrease the life of the motor and waste power. A switch could be employed by the user to turn on the electrical system whenever they wished to lie down on the bed. This would activate the electrical system only when needed. In this case, the restoring force could be provided by the electric motor alone.

An electric motor that applies a torque (and through the pulley, a force), but is not rotating, has no back-EMF. In the absence of a feedback mechanism, this results in a runaway driving current and motor burnout through resistive heating. Thus, a feedback mechanism is preferably employed. The feedback could be fed either to the motor controller, or to the signal processing unit. Sensing zero back-EMF, the motor controller or signal processing unit would then decrease the driving voltage to the motor. An alternative is to use a current source to drive the motor.

The signal processing unit can employ various algorithms to increase the functionality of the bed. For example, it could wait for a certain period of time after the user ceases movement before turning off, and/or it could turn the motor off slowly, so that traction was slowly applied.

In an electrical design, there is no need for a foot bed section, since the foot section is only necessary if the user needs to reset the center bed section manually. Only two bed sections are then necessary: 1) a head section, beginning at the user's head and ending at the waist, and 2) a lower section, extending from the user's waist past their feet. Eliminating the foot bed section simplifies the design, and may increase user comfort somewhat. Eliminating the foot section does have a downside, however, which is that it makes the bed somewhat shorter. Since there needs to be room at the foot of the bed for the lower section to move, this space necessarily cannot have a padded mattress in that location. Put another way, in some embodiments, a gap existed between the center bed section and foot bed section. If the foot section is eliminated, this gap must be moved to the very end of the bed. This gap therefore decreases the effective length of the bed.

In the absence of electrical power, the Basic Electrified Configuration continues to function as in other embodiments described herein. Therefore, even if power fails in the middle of the night, traction is continuously exerted. In the Basic Electrified Configuration, the electrical system is added to a bed which works even in the absence of the electrical system. This means that the standard, mechanical-only embodiments of the bed could be built in such a manner than an electrical "kit" could installed to turn it into an electrical bed. This allows prospective users to "upgrade" their mechanical-only bed at a later date. It also allows the manufacturer to sell two different versions of the bed, with parts standardized between the two versions.

Other Electrified Configurations

There are other ways to electrify the various embodiments of the beds described herein, which give similar functionality. In the mechanical-only designs, and in the Basic Electrified Configuration, the mode by which the traction force is increased or decreased is mechanical, and the exact method employed could be, among others, any of those outlined in Configs. A-F. However, one could also electrify the traction adjustment mechanism. For example, in Config. F, the traction is increased (decreased) by moving the rear spanning member 82 backwards (forwards). Rather than moving this component manually, in another embodiment, the spanning member is preferably moved via one or more electric motors which are mechanically linked to the rear spanning member. The method by which these are mechanically linked could be any conceivable method, but employing a worm gear(s) is most preferred. Such a configuration would allow the user to adjust the traction force while lying down, which would be convenient.

In another embodiment, an electric motor is preferably used to provide the tractive force directly, rather than providing the restoring force. In this case the electric motor is preferably turned on when the user was not moving, and turned off when the user moved. A pulley/rope system is preferably employed, similar to that employed in the Basic Electrified Configuration. In this case, however, when the motor is turned on, it pulls the center bed section towards the foot of the bed, rather than toward the head of the bed. A static restoring force is preferably applied by one of the mechanisms already discussed (weight/pulley, elastic band, etc.).

In another embodiment, two electric motors are used, one providing a tractive force and one providing a restoring force.

In another embodiment, one reversible-direction electric motor is preferably used to provide both the tractive force and the restoring force. By turning the electric motor in one direction a traction force could be exerted. By turning it in the opposite direction, a restoring force could be exerted.

In another embodiment, rather than employing electric motors to generate forces, solenoids are preferably employed. These solenoids could be mechanically linked to the center bed section though simple direct linkages, or through pulley systems or gearboxes.

In another embodiment of an electrified configuration, the head section of the bed is preferably movable. That is, the lower bed section, which extends from the user's low back to his feet, is fixed in place, and the head section is movable. In use, the center section would move forward (toward the head of the bed) a small amount, so as to place the user's back in traction. All methods, mechanical and electrical, heretofore discussed may be employed to move the head bed section.

Comparison of the Configurations and Further Modifications

Each of the embodiments of the present invention described herein have various advantages in relation to each other. Accordingly, a particular configuration employed can be chosen based on the needs and desires of the particular user. Bed 100 is the simplest to construct, but the traction force varies as center bed section 21 displaces. Bed 101 is more complex, but it is easier in this design to alter the tractive force by altering the restoring force. Also, the restoring force is constant, which is an advantage. Bed 102 is yet more complicated to construct but has the aesthetic advantage of looking more like a normal bed, and is easier to get into and out of. It maintains the advantage inherent in bed 100 and bed 101, in that it is possible to raise or lower center bed section 21. Bed 103 does not need the adjustments to cable length that bed 100, bed 101 and bed 102 need, but owing to the need to fabricate compressional supports 45, it is likely to be more expensive. It also has the disadvantage of increasing the traction force as the displacement of its center bed section 21 b increases. Bed 104 has the distinct advantage of having no change in traction force due to changing bed geometry. However, the high-quality bearings, wheels, and rails necessary for this design to work increase the cost and complexity. Bed 105 has less variation in the traction force (with displacement of the center bed section) than bed 100, bed 101, bed 102, and bed 103, but is more complex than these designs. However, it is likely to be more economical to construct than bed 104. Bed 106 has the same advantages and disadvantages as bed 100, and variations on this design based on the features found in bed 101, bed 102, bed 103, bed 104 and bed 105 will have the same advantages and disadvantages as those configurations. Overall, bed 105 is likely the configuration with the greatest advantages and the least disadvantages.

All configurations can be built in whatever width is desired. Bed 102, bed 103, bed 104 and bed 105 can be easily integrated with a traditional bed so that partners can sleep in the same bed. To do this, one simply places a bed of one of these configurations side-by-side with a traditional bed of the same height. A single king size bed frame can be used if both beds are twin XL sizes. Separate bottom sheets may be necessary to allow the appropriate range of motion for the center bed section of the traction bed. The beds can be fixed to each other by hardware if desired. Because the center section of the traction bed preferably possesses a small degree of freedom of movement, the bottom sheet of this bed is preferably somewhat loose fitting and the center section is preferably somewhat narrow relative to the rest of the bed to avoid frictional contract of this section with the neighboring bed.

The various configurations described herein often employ different reference numbers to refer to objects that are similar across the various configurations. For example, the description of bed 100 refers to head bed section 1 while the description of bed 102 refers to immobile head 22. Sometimes features are described without reference to a reference number, which case it should be presumed that the description of that feature applies to all the various embodiments of the bed that include that feature. For example, the section of this application describing the motorized embodiments refers to features of the bed without reference to reference numbers even though it is intended to refer to all the configurations of the beds that could possibly include that feature. Any particular component described in any one configuration is intended to incorporate the structures, features and characteristics of the corresponding or similar components described in all other configurations, unless such would render that components inoperative, non-sensical or as otherwise stated.

Note also that in the specification and claims, "about" or "approximately" means within twenty percent (20%) of the numerical amount cited.

Although the invention has been described in detail with particular reference to the disclosed embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another.

What is claimed is:

1. A bed apparatus for treating or relieving spinal pain of a user, the bed apparatus comprising:

a main frame comprising a head end and a foot end;

a movable section disposed on said main frame between said head end and said foot end, said movable section supported by a support apparatus and configured to move in relation to said main frame when there is a change in the weight applied to said movable section;

a restorative force apparatus disposed on said movable section;

a head section comprising a head platform disposed on said main frame at or adjacent to said head end;

a foot section comprising a foot platform disposed at or adjacent to said foot end;

wherein said movable section comprises a center platform disposed between said head section and said foot section;

wherein said movable section further comprises a subframe, and wherein said support apparatus comprises a tensional support and a compressional support, and wherein said restorative force apparatus is communicably coupled to apply force to at least one of said subframe, said movable section or said support apparatus; and wherein said movable section is configured such that its center of mass lies about halfway between said tensional support and said compressional support.

2. The bed apparatus of claim 1 wherein said tensional support is placed in tension by fixing its top in place relative to said main frame and is otherwise able to move towards and away from said head end and said foot end.

3. The bed apparatus of claim 1 wherein said tensional support comprises a spanning member at its top that can be moved towards the head of the bed or towards the foot of the bed.

4. The bed apparatus of claim 1 wherein said compressional support is placed in compression by fixing its bottom in place relative to said main frame and is otherwise able to move towards and away from said head end and said foot end.

5. The bed apparatus of claim 1 wherein said compressional support comprises a spanning member at its bottom that coordinates with said main frame.

6. The bed apparatus of claim 1 wherein said subframe further comprises rails on opposite sides of said subframe and cross members on opposite ends of said subframe, said rails and cross members attached together such that they move together as a unit.

7. The bed apparatus of claim 1 wherein said main frame comprises at least one position coordinator at or near said foot end to receive said foot section at one or more positions along the length of the bed apparatus.

8. The bed apparatus of claim 7 wherein said at least one position coordinator comprises notches or slots.

9. The bed apparatus of claim 1 wherein said center platform is narrower in width than both said head section and said foot section.

10. The bed apparatus of claim 1 wherein said head platform is removably attachable to said main frame or rotatable therefrom.

11. The bed apparatus of claim 1 wherein said center platform is removably attachable to said subframe or rotatable therefrom.

12. The bed apparatus of claim 1 wherein said head section further comprises a head mattress section disposed on said head platform, said foot section further comprises a foot mattress section disposed on said foot platform, and said movable section further comprises a center mattress section disposed on said center platform.

13. The bed apparatus of claim 12 wherein said foot mattress section is thinner in depth than each of said head mattress section and said center mattress section.

14. The bed apparatus of claim 1 wherein said head platform and said center platform are angled in relation to said foot platform.

15. The bed apparatus of claim 1 wherein said subframe further comprises holders for blocks disposed between said subframe and said center platform, and wherein said main frame further comprises holders for blocks disposed between said main frame and said head platform.

16. The bed apparatus of claim 15 further comprising weight sensors disposed on said holders or beneath said blocks.

17. The bed apparatus of claim 1 further comprising weight sensors.

18. The bed apparatus of claim 1 wherein said main frame comprises at least one panel extending above at least one of said head platform or said foot platform, said support apparatus comprising said tensional support disposed on each of said at least one panel and said movable section.

19. The bed apparatus of claim 18 wherein said at least one panel comprises a first panel on a first side of said bed and a second panel on an opposite side of said bed.

20. The bed apparatus of claim 18 wherein said tensional support comprises at least two cables, a first cable attached to said first panel and said center section and a second cable attached to said second panel and said center section.

21. The bed apparatus of claim 20 wherein each of said first and said second cables comprise an adjustment apparatus for adjusting the length thereof.

22. The bed apparatus of claim 20 wherein said first panel and said second panel each comprise at least one cable receiver to provide a plurality of different mounting-positions for said cables.

23. The bed apparatus of claim 22 wherein said at least one cable receiver comprises notches or slots at or near the top of a respective one of said first panel and said second panel.

24. The bed apparatus of claim 1 wherein said restorative force apparatus comprises at least one of the group consisting of an elastic band, cable and weight, cable and spring, cable and ratchet, cable and spring and ratchet, hydraulic mechanism, and motorized device.

25. The bed apparatus of claim 1 wherein said movable section comprises a supported base platform and a support base, wherein said supported base platform is at least partially disposed above said support base and said supported base platform is suspended in relation to said support base by said support apparatus.

26. The bed apparatus of claim 25 wherein said restorative force apparatus is attached to said supported base platform.

27. The bed apparatus of claim 25 wherein said support apparatus comprises said tensional support and said tensional support comprises a plurality of cables.

28. The bed apparatus of claim 25 wherein said foot section comprises a foot section base and said foot section base is attached to said support base by a bridge.

29. The bed apparatus of claim 25 wherein said main frame comprises rails and each of said head section, foot section and movable section are disposed on said rails.

30. The bed apparatus of claim 25 further comprising a gap between said foot section and said foot end of said main frame.

31. The bed apparatus of claim 1 wherein said support apparatus comprises wheels or bearings.

32. The bed apparatus of claim 31 wherein said main frame is inclined at an angle relative to the ground.

33. A method of applying a microtraction force to the spine of a user to treat or relieve spinal pain, the method comprising:

configuring a movable section of a bed to move in relation to a main frame of the bed comprising a head end and a foot end when there is a change in the weight applied to the movable section of the bed, wherein the movable section of the bed is disposed on the main frame between the head end and the foot end of the bed, the movable section is supported by a support apparatus and configured to move in relation to the main frame when there is a change in the weight applied to the movable section, and the bed comprises: a restorative force apparatus disposed on the movable section; a head section comprising a head platform disposed on the main frame at or adjacent to the head end; a foot section comprising a foot platform disposed at or adjacent to the foot end; and wherein the movable section of the bed comprises a center platform disposed between the head section and the foot section, the movable section of the bed comprises a subframe, the support apparatus comprises a tensional support and a compressional support, and the restorative force apparatus is communicably coupled to apply force to at least one of the subframe, the movable section or the support apparatus, and wherein the movable section is configured such that its center of mass lies about halfway between the tensional support and the compressional support ; and applying a force to the movable section of the bed in either the direction of the head end or the foot end of the bed to apply a traction force to the spine of the user when the user applies at least some of his or her weight to the movable section of the bed, which force is a function of weight applied to the movable section of the bed.

* * * * *